US011641552B2

(12) United States Patent
Qi et al.

(10) Patent No.: US 11,641,552 B2
(45) **Date of Patent: *May 2, 2023**

(54) BONE CONDUCTION SPEAKER AND COMPOUND VIBRATION DEVICE THEREOF

(71) Applicant: SHENZHEN SHOKZ CO., LTD., Guangdong (CN)

(72) Inventors: Xin Qi, Shenzhen (CN); Fengyun Liao, Shenzhen (CN); Jinbo Zheng, Shenzhen (CN); Qian Chen, Shenzhen (CN); Hao Chen, Shenzhen (CN); Lei Zhang, Shenzhen (CN); Junjiang Fu, Shenzhen (CN); Bingyan Yan, Shenzhen (CN)

(73) Assignee: SHENZHEN SHOKZ CO., LTD., Shenzhen (CN)

( * ) Notice: Subject to any disclaimer, the term of this patent is extended or adjusted under 35 U.S.C. 154(b) by 82 days.

This patent is subject to a terminal disclaimer.

(21) Appl. No.: 17/218,713

(22) Filed: Mar. 31, 2021

(65) Prior Publication Data

US 2021/0250698 A1 Aug. 12, 2021

Related U.S. Application Data

(63) Continuation-in-part of application No. 17/170,955, filed on Feb. 9, 2021, and a continuation-in-part of (Continued)

(30) Foreign Application Priority Data

Dec. 23, 2011 (CN) ..... 201110438083.9
Apr. 30, 2019 (CN) ..... 201910364346.2
(Continued)

(51) Int. Cl.
*H04R 9/06* (2006.01)
*H04R 1/00* (2006.01)
(Continued)

(52) U.S. Cl.
CPC ..... *H04R 9/063* (2013.01); *H04R 1/00* (2013.01); *H04R 1/10* (2013.01); *H04R 9/02* (2013.01);
(Continued)

(58) Field of Classification Search
CPC ..... H04R 9/063; H04R 1/00; H04R 1/10; H04R 1/1075; H04R 9/02; H04R 9/06;
(Continued)

(56) References Cited

U.S. PATENT DOCUMENTS 2,075,196 A 3/1937 Hand
4,418,248 A 11/1983 Mathis
(Continued)

FOREIGN PATENT DOCUMENTS

CN 1842019 A 10/2006
CN 1976541 A 6/2007
(Continued)

OTHER PUBLICATIONS

First Office Action in Chinese Application No. 201110438083.9 dated Sep. 27, 2012, 10 pages.
(Continued)

*Primary Examiner* — Norman Yu
(74) *Attorney, Agent, or Firm* — Metis IP LLC

(57) ABSTRACT

The present disclosure relates to a bone conduction speaker and its compound vibration device. The compound vibration device comprises a vibration conductive plate and a vibration board, the vibration conductive plate is set to be the first torus, where at least two first rods inside it converge to its center; the vibration board is set as the second torus, where
(Continued)

at least two second rods inside it converge to its center. The vibration conductive plate is fixed with the vibration board; the first torus is fixed on a magnetic system, and the second torus comprises a fixed voice coil, which is driven by the magnetic system. The bone conduction speaker in the present disclosure and its compound vibration device adopt the fixed vibration conductive plate and vibration board, making the technique simpler with a lower cost; because the two adjustable parts in the compound vibration device can adjust both low frequency and high frequency area, the frequency response obtained is flatter and the sound is broader.

20 Claims, 18 Drawing Sheets

Related U.S. Application Data application No. 17/170,817, filed on Feb. 8, 2021, now Pat. No. 11,395,072, which is a continuation of application No. 17/161,717, filed on Jan. 29, 2021, now Pat. No. 11,399,234, said application No. 17/170,955 is a continuation of application No. PCT/CN2020/083631, filed on Apr. 8, 2020, said application No. 17/161,717 is a continuation-in-part of application No. 16/833,839, filed on Mar. 30, 2020, now Pat. No. 11,399,245, and a continuation-in-part of application No. 16/159,070, filed on Oct. 12, 2018, now Pat. No. 10,911,876, said application No. 16/159,070 is a continuation of application No. 15/197,050, which is a continuation of application No. 15/752,452, filed as application No. PCT/CN2015/086907 on Aug. 13, 2015, now Pat. No. 10,609,496, which is a continuation of application No. 14/513,371, filed on Oct. 14, 2014, now Pat. No. 9,402,116, which is a continuation of application No. 13/719,754, filed on Dec. 19, 2012, now Pat. No. 8,891,792.

(30) Foreign Application Priority Data

Sep. 19, 2019 (CN) ..... 201910888067.6
Sep. 19, 2019 (CN) ..... 201910888762.2

(51) Int. Cl.

| | |
|---|---|
| ***H04R 9/02*** | (2006.01) |
| ***H04R 31/00*** | (2006.01) |
| ***H04R 1/10*** | (2006.01) |
| *H04R 25/00* | (2006.01) |

(52) U.S. Cl.

CPC ..... *H04R 9/025* (2013.01); *H04R 9/066* (2013.01); *H04R 31/00* (2013.01); *H04R 25/606* (2013.01); *H04R 2460/13* (2013.01)

(58) Field of Classification Search

CPC ..... H04R 9/025; H04R 9/066; H04R 11/02; H04R 31/00; H04R 25/606; H04R 2225/021; H04R 2225/023; H04R 2225/67; H04R 2400/03; H04R 2420/07; H04R 2460/13; H04R 2499/11; H04R 25/48

USPC ..... 381/151, 380, 162, 182, 326; 340/7.6; 600/25

See application file for complete search history.

(56) References Cited

U.S. PATENT DOCUMENTS

| | | | | |
|---|---|---|---|---|
| 5,127,060 | A | 6/1992 | Paddock | |
| 5,673,328 | A | 9/1997 | Wandl et al. | |
| 5,734,132 | A | 3/1998 | Proni | |
| 5,790,684 | A | 8/1998 | Niino et al. | |
| 6,389,148 | B1 | 5/2002 | Yoo et al. | |
| 6,738,485 | B1 | 5/2004 | Boesen | |
| 6,850,138 | B1 | 2/2005 | Sakai | |
| 8,691,792 | B2 | 4/2014 | Xu et al. | |
| 9,226,075 | B2 | 12/2015 | Lee | |
| 9,253,563 | B2 | 2/2016 | Fukuda | |
| 9,742,887 | B2 | 8/2017 | Hosoi et al. | |
| 2003/0012395 | A1 | 1/2003 | Fukuda | |
| 2003/0053651 | A1 | 3/2003 | Koura et al. | |
| 2004/0105566 | A1 | 6/2004 | Matsunaga et al. | |
| 2004/0131218 | A1 | 7/2004 | Dedieu et al. | |
| 2006/0098829 | A1 | 5/2006 | Kobayashi | |
| 2006/0165246 | A1 | 7/2006 | Lee et al. | |
| 2006/0262954 | A1 | 11/2006 | Lee et al. | |
| 2007/0053536 | A1 | 3/2007 | Westerkull | |
| 2008/0166007 | A1 | 7/2008 | Hankey et al. | |
| 2009/0097681 | A1 | 4/2009 | Puria et al. | |
| 2009/0209806 | A1 | 8/2009 | Hakansson | |
| 2009/0245553 | A1 | 10/2009 | Parker | |
| 2009/0285417 | A1 | 11/2009 | Shin et al. | |
| 2010/0046783 | A1 | 2/2010 | Huang | |
| 2010/0329485 | A1 | 12/2010 | Fukuda | |
| 2011/0022119 | A1 | 1/2011 | Parker | |
| 2012/0020501 | A1* | 1/2012 | Lee | H04R 1/1016 381/151 |
| 2012/0083860 | A1 | 4/2012 | Hakansson | |
| 2012/0281861 | A1 | 11/2012 | Lin | |
| 2012/0286765 | A1* | 11/2012 | Heuvel | H04R 25/606 600/25 |
| 2012/0302822 | A1 | 11/2012 | Van Himbeeck et al. | |
| 2013/0121513 | A1 | 5/2013 | Adachi | |
| 2013/0156241 | A1 | 6/2013 | Jinton | |
| 2013/0163791 | A1 | 6/2013 | Qi et al. | |
| 2013/0308798 | A1 | 11/2013 | Lee | |
| 2014/0064533 | A1 | 3/2014 | Kasic, II | |
| 2014/0270293 | A1 | 9/2014 | Ruppersberg et al. | |
| 2015/0130945 | A1* | 5/2015 | Yu | G01S 19/13 381/151 |
| 2015/0208183 | A1 | 7/2015 | Bern | |
| 2015/0264473 | A1 | 9/2015 | Fukuda | |
| 2016/0037243 | A1 | 2/2016 | Lippert et al. | |
| 2016/0127841 | A1 | 5/2016 | Horii | |
| 2017/0201823 | A1 | 7/2017 | Shetye et al. | |
| 2017/0374479 | A1 | 12/2017 | Qi et al. | |
| 2019/0014425 | A1 | 1/2019 | Liao et al. | |
| 2019/0052954 | A1 | 2/2019 | Rusconi Clerici Beltrami et al. | |
| 2019/0238971 | A1 | 8/2019 | Wakeland et al. | |

FOREIGN PATENT DOCUMENTS

| | | | |
|---|---|---|---|
| CN | 101098353 | A | 1/2008 |
| CN | 202435598 | U | 9/2012 |
| CN | 203233520 | U | 10/2013 |
| CN | 105007551 | A | 10/2015 |
| CN | 105101019 | A | 11/2015 |
| CN | 105101020 | A | 11/2015 |
| CN | 105142077 | A | 12/2015 |
| CN | 204887455 | U | 12/2015 |
| CN | 205142506 | U | 4/2016 |
| EP | 1404146 | A1 | 3/2004 |
| EP | 2234413 | B1 | 11/2020 |
| JP | S5574290 | A | 6/1980 |
| JP | 07007797 | A | 1/1995 |
| JP | 2003264882 | A | 9/2003 |
| JP | 2004064457 | A | 2/2004 |
| JP | 2004158961 | A | 6/2004 |
| JP | 2005151183 | A | 6/2005 |
| JP | 2006025333 | A | 1/2006 |
| JP | 2007129384 | A | 5/2007 |
| JP | 2008017398 | A | 1/2008 |

(56) References Cited

FOREIGN PATENT DOCUMENTS

| | | | |
|---|---|---|---|
| JP | 2008054063 | A | 3/2008 |
| JP | 2011160175 | A | 8/2011 |
| JP | 2013243564 | A | 12/2013 |
| KR | 20010111653 | A | 12/2001 |
| KR | 20050030183 | A | 3/2005 |
| KR | 20070122104 | A | 12/2007 |
| KR | 20080101166 | A | 11/2008 |
| KR | 20090082999 | A | 8/2009 |
| KR | 20090091378 | A | 8/2009 |
| KR | 20110037483 | A | 4/2011 |
| KR | 200476572 | Y1 | 3/2015 |
| WO | 0219759 | A1 | 3/2002 |
| WO | 2006088410 | A1 | 8/2006 |
| WO | 2010114195 | A1 | 10/2010 |
| WO | 2018107141 | A1 | 6/2018 |

OTHER PUBLICATIONS

The Extended European Search Report in European Application No. 12860348.7 dated Apr. 28, 2015, 7 pages.
International Search Report in PCT/CN2012/086513 dated Mar. 14, 2013, 5 pages.
Written Opinion in PCT/CN2012/086513 dated Mar. 14, 2013, 10 pages.
International Search Report in PCT/CN2015/086907 dated May 6, 2016, 10 pages.
Written Opinion in PCT/CN2015/086907 dated May 6, 2016, 12 pages.
Communication Pursuant to Article 94(3) EPC in European Application No. 15900793.9 dated Apr. 10, 2019, 6 pages.
Communication Pursuant to Article 94(3) EPC in European Application No. 15900793.9 dated Apr. 28, 2020, 9 pages.
Notice of Reasons for Rejection in Japanese Application No. 2018-506985 dated Sep. 3, 2019, 8 pages.
Notice of Reasons for Rejection in Japanese Application No. 2018-146019 dated Jul. 23, 2019, 8 pages.
Decision of Final Rejection in Japanese Application No. 2018-146019 dated Jan. 21, 2020, 9 pages.
Notice of Reasons for Rejection in Japanese Application No. 2018-146020 dated Jul. 23, 2019, 8 pages.
Notice of Reasons for Rejection in Japanese Application No. 2018-146021 dated Jul. 30, 2019, 8 pages.
Decision to Grant a Patent in Japanese Application No. 2018-146021 dated Jul. 21, 2020, 5 pages.
Written Opinion in PCT/CN2020/083631 dated Jun. 29, 2020, 4 pages.
International Search Report in PCT/CN2020/083631 dated Jun. 29, 2020, 4 pages.
Notice of Preliminary Rejection in Republic of Korea Application No. 10-2018-7007115 dated May 20, 2021, 9 pages.
Notice of Preliminary Rejection in Korean Application No. 10-2022-7003237 dated Apr. 13, 2022, 14 pages.
Notice of Reasons for Rejection in Japanese Application No. 2020-088413 dated Aug. 3, 2021, 8 pages.
M. Gripper et al., Using the Callsign Acquisition Test (CAT) to Compare the Speech Intelligibility of Air Versus Bone Conduction, International Journal of Industrial Ergonomics, 37(7): 631-641, 2007.
Martin L. Lenhardt et al., Measurement of Bone Conduction Levels for High Frequencies, International Tinnitus Journal, 8(1): 9-12, 2002.
The Extended European Search Report in European Application No. 21186537.3 dated Nov. 9, 2021, 9 pages.
Notice of Reasons for Refusal in Japanese Application No. 2020-088413 dated Sep. 6, 2022, 11 pages.
The Second Notice of Preliminary Rejection in Korean Application No. 10-2022-7003237 dated Oct. 11, 2022, 14 pages.
Notice of Reasons for Refusal in Japanese Application No. 2021-179711 dated Oct. 18, 2022, 8 pages.
The Office Action in Brazilian Application No. BR112018002854-1 dated Feb. 24, 2023, 8 pages.
Paula Henry et al., Bone Conduction: Anatomy, Physiology, and Communication, Army Research Laboratory, 2007, 206 pages.

* cited by examiner

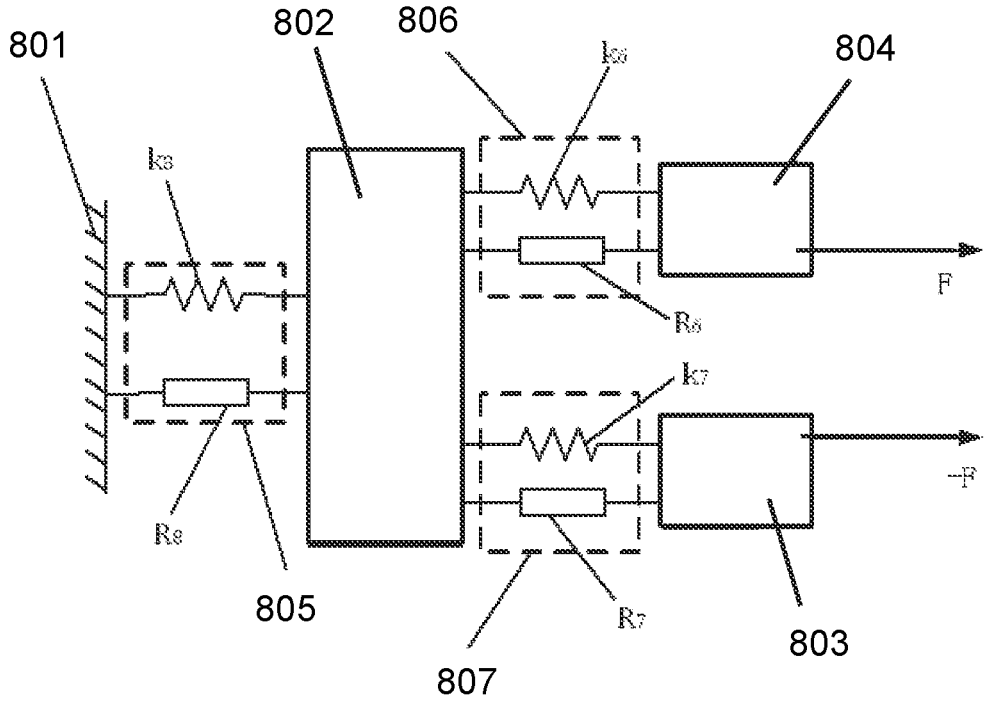
FIG. 8-A

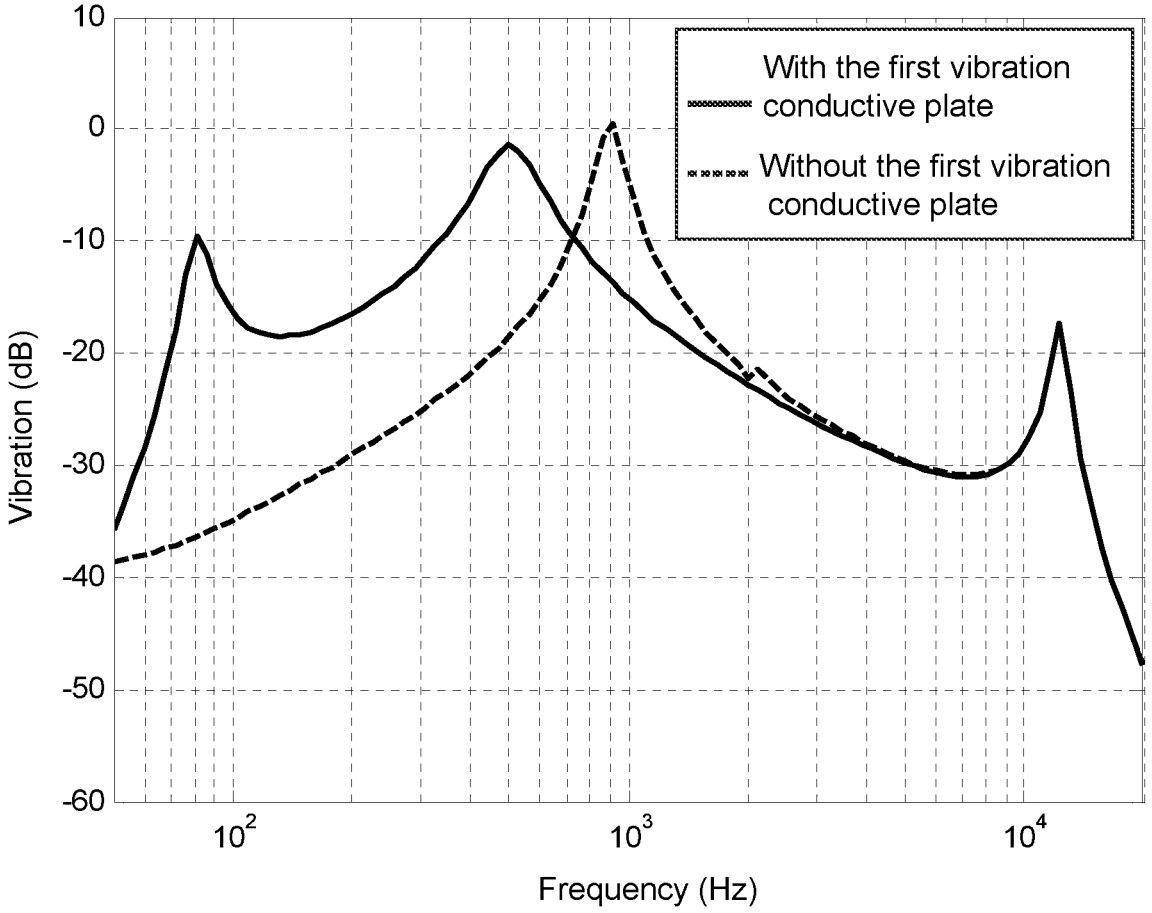
FIG. 8-B

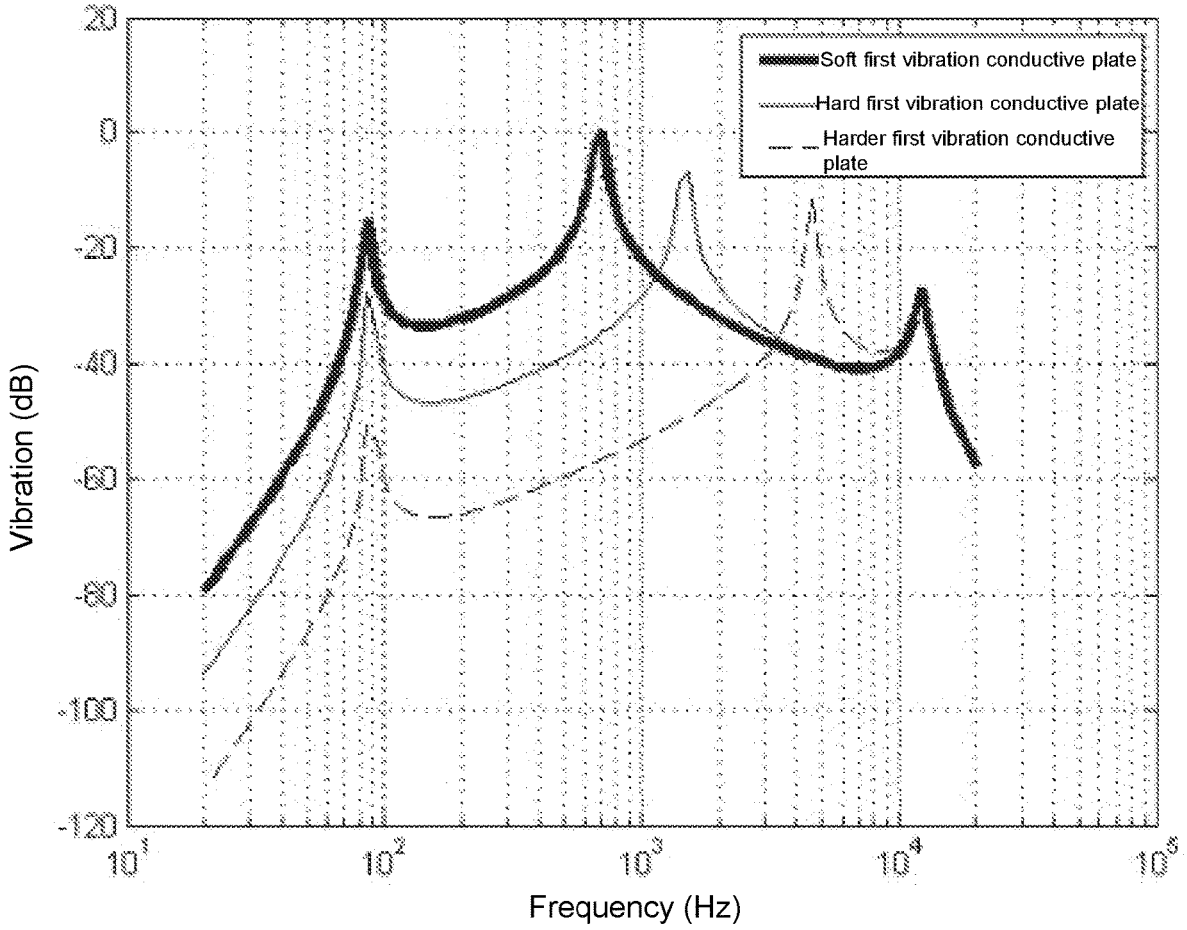
FIG. 8-C

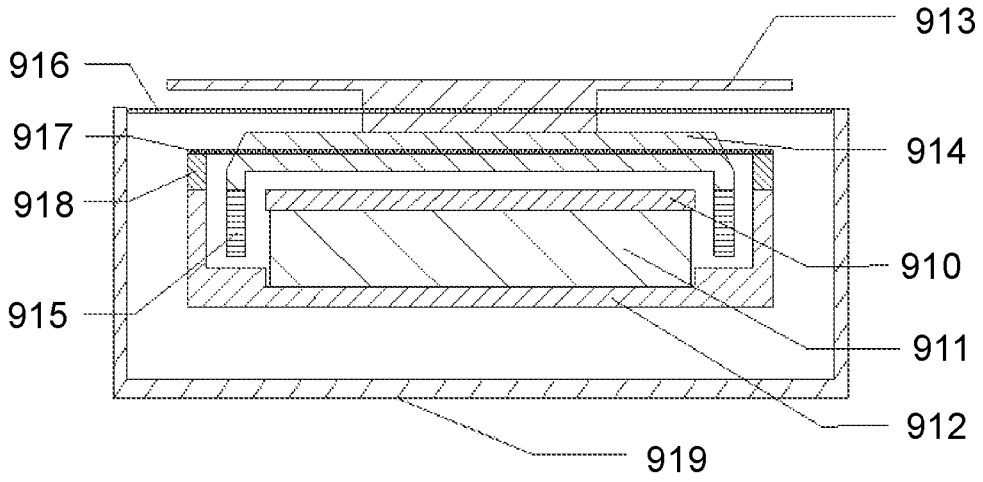
FIG. 9-A

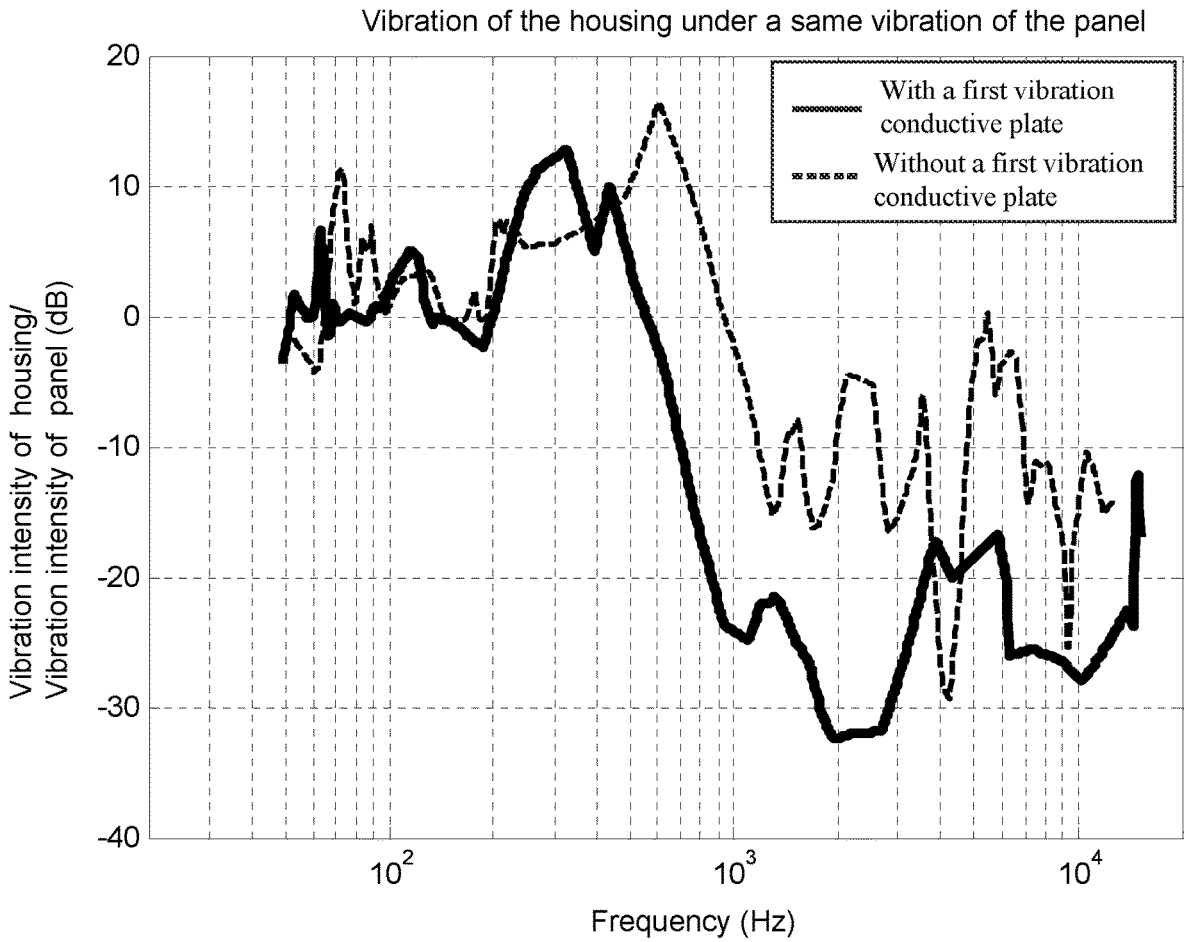
FIG. 9-B

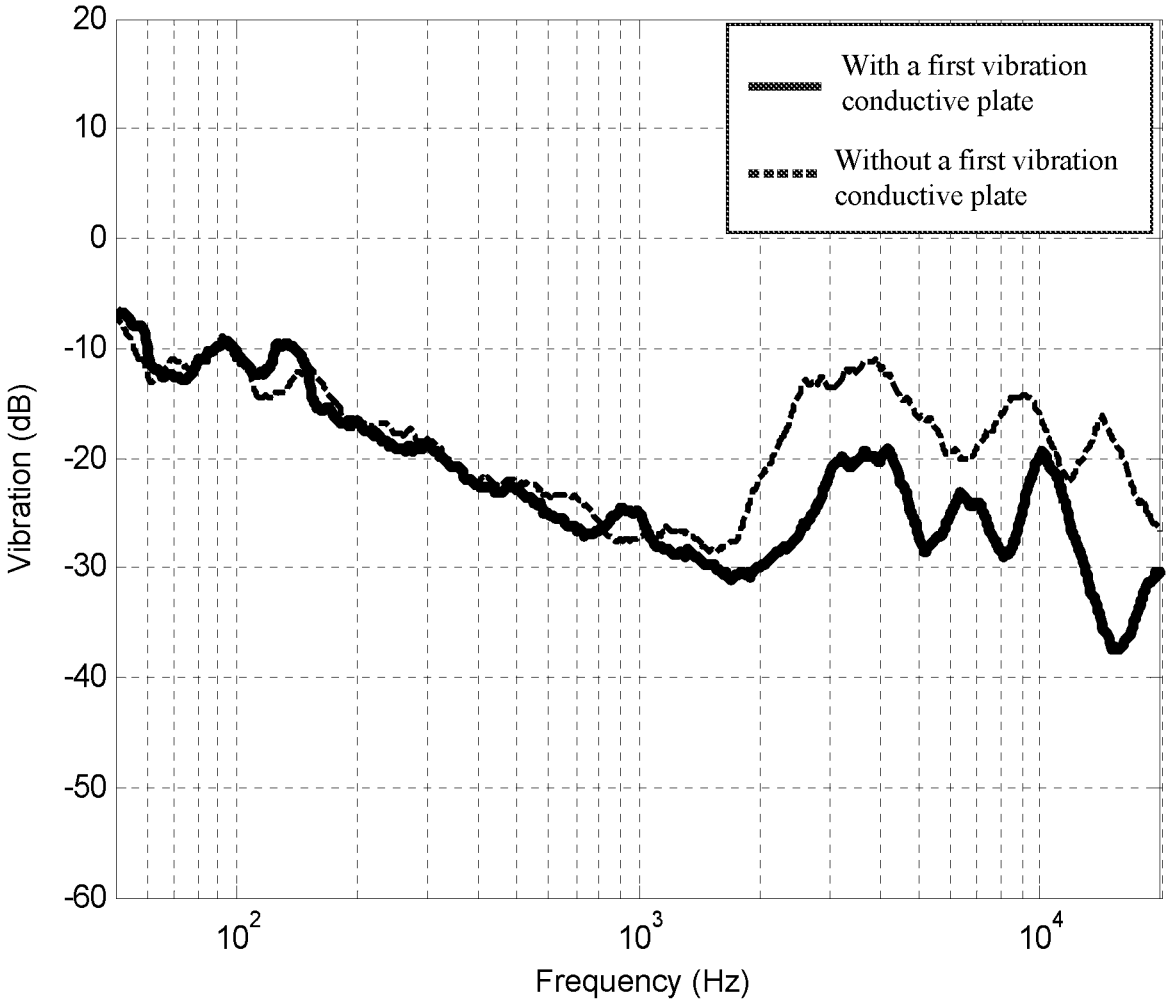
FIG. 9-C

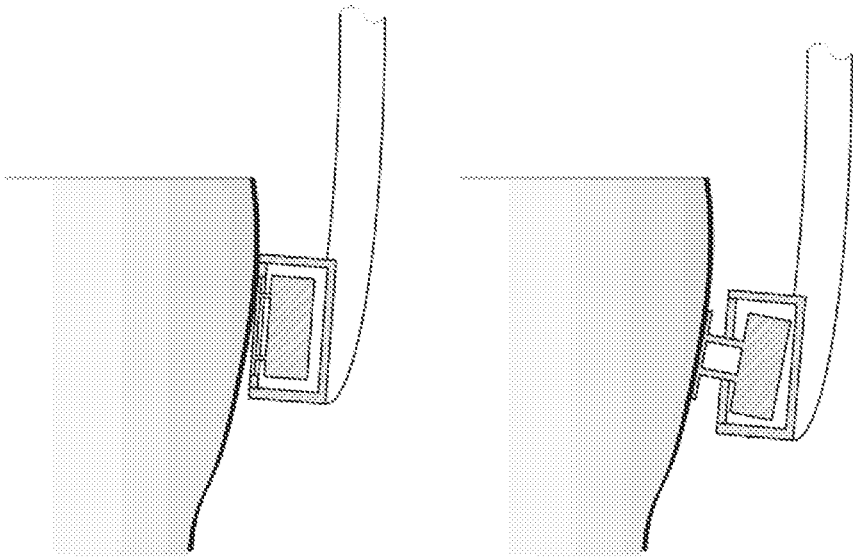
FIG. 11-A

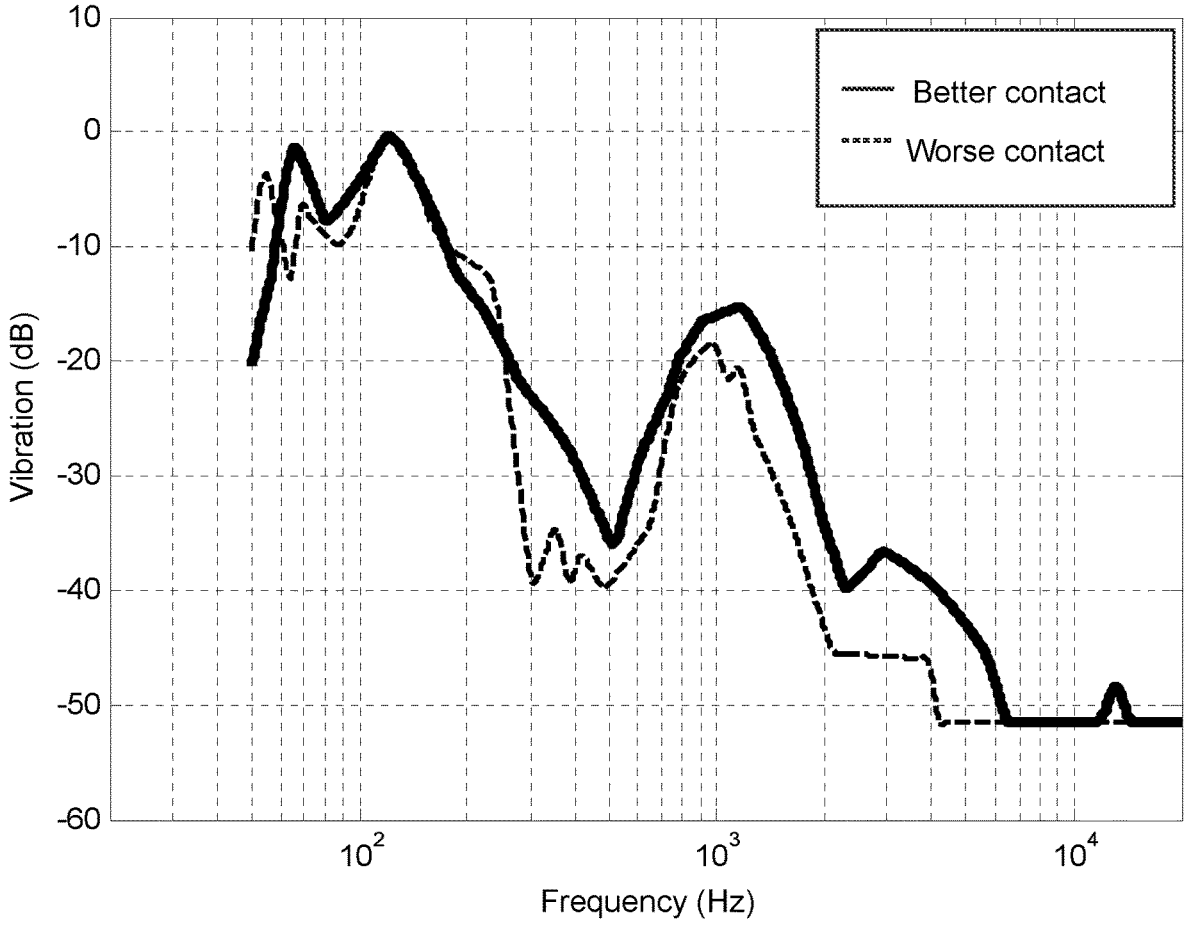
FIG. 11-B

BONE CONDUCTION SPEAKER AND COMPOUND VIBRATION DEVICE THEREOF

CROSS-REFERENCE TO RELATED APPLICATIONS

This application is a continuation-in-part application of U.S. patent application Ser. No. 17/170,817, filed on Feb. 8, 2021, which is a continuation of U.S. patent application Ser. No. 17/161,717, filed on Jan. 29, 2021, which is a continuation-in-part application of U.S. patent application Ser. No. 16/159,070 (issued as U.S. Pat. No. 10,911,876), filed on Oct. 12, 2018, which is a continuation of U.S. patent application Ser. No. 15/197,050 (issued as U.S. Pat. No. 10,117,026), filed on Jun. 29, 2016, which is a continuation of U.S. patent application Ser. No. 14/513,371 (issued as U.S. Pat. No. 9,402,116), filed on Oct. 14, 2014, which is a continuation of U.S. patent application Ser. No. 13/719,754 (issued as U.S. Pat. No. 8,891,792), filed on Dec. 19, 2012, which claims priority to Chinese Patent Application No. 201110438083.9, filed on Dec. 23, 2011; U.S. patent application Ser. No. 17/161,717, filed on Jan. 29, 2021 is also a continuation-in-part application of U.S. patent application Ser. No. 16/833,839, filed on Mar. 30, 2020, which is a continuation of U.S. application Ser. No. 15/752,452 (issued as U.S. Pat. No. 10,609,496), filed on Feb. 13, 2018, which is a national stage entry under 35 U.S.C. § 371 of International Application No. PCT/CN2015/086907, filed on Aug. 13, 2015; this application is also a continuation-in-part of U.S. patent application Ser. No. 17/170,955, filed on Feb. 9, 2021, which is a Continuation of International Application No. PCT/CN2020/083631, filed on Apr. 8, 2020, which claims priority to Chinese Application No. 201910888067.6, filed on Sep. 19, 2019, Chinese Application No. 201910888762.2, filed on Sep. 19, 2019, and Chinese Application No. 201910364346.2, filed on Apr. 30, 2019. Each of the above-referenced applications is hereby incorporated by reference.

TECHNICAL FIELD

The present disclosure relates to improvements on a bone conduction speaker and its components, in detail, relates to a bone conduction speaker and its compound vibration device, while the frequency response of the bone conduction speaker has been improved by the compound vibration device, which is composed of vibration boards and vibration conductive plates.

BACKGROUND

Based on the current technology, the principle that we can hear sounds is that the vibration transferred through the air in our external acoustic meatus, reaches to the ear drum, and the vibration in the ear drum drives our auditory nerves, makes us feel the acoustic vibrations. The current bone conduction speakers are transferring vibrations through our skin, subcutaneous tissues and bones to our auditory nerves, making us hear the sounds.

When the current bone conduction speakers are working, with the vibration of the vibration board, the shell body, fixing the vibration board with some fixers, will also vibrate together with it, thus, when the shell body is touching our post auricles, cheeks, forehead or other parts, the vibrations will be transferred through bones, making us hear the sounds clearly.

However, the frequency response curves generated by the bone conduction speakers with current vibration devices are shown as the two solid lines in FIG. 4. In ideal conditions, the frequency response curve of a speaker is expected to be a straight line, and the top plain area of the curve is expected to be wider, thus the quality of the tone will be better, and easier to be perceived by our ears. However, the current bone conduction speakers, with their frequency response curves shown as FIG. 4, have overtopped resonance peaks either in low frequency area or high frequency area, which has limited its tone quality a lot. Thus, it is very hard to improve the tone quality of current bone conduction speakers containing current vibration devices. The current technology needs to be improved and developed.

SUMMARY

The purpose of the present disclosure is providing a bone conduction speaker and its compound vibration device, to improve the vibration parts in current bone conduction speakers, using a compound vibration device composed of a vibration board and a vibration conductive plate to improve the frequency response of the bone conduction speaker, making it flatter, thus providing a wider range of acoustic sound.

The technical proposal of present disclosure is listed as below:

A compound vibration device in bone conduction speaker contains a vibration conductive plate and a vibration board, the vibration conductive plate is set as the first torus, where at least two first rods in it converge to its center. The vibration board is set as the second torus, where at least two second rods in it converge to its center. The vibration conductive plate is fixed with the vibration board. The first torus is fixed on a magnetic system, and the second torus contains a fixed voice coil, which is driven by the magnetic system.

In the compound vibration device, the magnetic system contains a baseboard, and an annular magnet is set on the board, together with another inner magnet, which is concentrically disposed inside this annular magnet, as well as an inner magnetic conductive plate set on the inner magnet, and the annular magnetic conductive plate set on the annular magnet. A grommet is set on the annular magnetic conductive plate to fix the first torus. The voice coil is set between the inner magnetic conductive plate and the annular magnetic plate.

In the compound vibration device, the number of the first rods and the second rods are both set to be three.

In the compound vibration device, the first rods and the second rods are both straight rods.

In the compound vibration device, there is an indentation at the center of the vibration board, which adapts to the vibration conductive plate.

In the compound vibration device, the vibration conductive plate rods are staggered with the vibration board rods.

In the compound vibration device, the staggered angles between rods are set to be 60 degrees.

In the compound vibration device, the vibration conductive plate is made of stainless steel, with a thickness of 0.1-0.2 mm, and, the width of the first rods in the vibration conductive plate is 0.5-1.0 mm; the width of the second rods in the vibration board is 1.6-2.6 mm, with a thickness of 0.8-1.2 mm.

In the compound vibration device, the number of the vibration conductive plate and the vibration board is set to be more than one. They are fixed together through their centers and/or torus.

A bone conduction speaker comprises a compound vibration device which adopts any methods stated above.

The bone conduction speaker and its compound vibration device as mentioned in the present disclosure, adopting the fixed vibration boards and vibration conductive plates, make the technique simpler with a lower cost. Also, because the two parts in the compound vibration device can adjust low frequency and high frequency areas, the achieved frequency response is flatter and wider, the possible problems like abrupt frequency responses or feeble sound caused by single vibration device will be avoided.

BRIEF DESCRIPTION OF THE DRAWINGS

FIG. 8-A illustrates an equivalent vibration model of the vibration portion of the bone conduction speaker according to some embodiments of the present disclosure;

FIG. 8-B illustrates a vibration response curve of the bone conduction speaker according to one specific embodiment of the present disclosure;

FIG. 8-C illustrates a vibration response curve of the bone conduction speaker according to one specific embodiment of the present disclosure;

FIG. 9-A illustrates a structure of the vibration generation portion of the bone conduction speaker according to one specific embodiment of the present disclosure;

FIG. 9-B illustrates a vibration response curve of the bone conduction speaker according to one specific embodiment of the present disclosure;

FIG. 9-C illustrates a sound leakage curve of the bone conduction speaker according to one specific embodiment of the present disclosure;

FIG. 11-A illustrates an application scenario of the bone conduction speaker according to one specific embodiment of the present disclosure;

FIG. 11-B illustrates a vibration response curve of the bone conduction speaker according to one specific embodiment of the present disclosure;

DETAILED DESCRIPTION

A detailed description of the implements of the present disclosure is stated here, together with attached figures.

An acoustic output apparatus in the present disclosure may refer to a device having a sound output function. In practical applications, the acoustic output apparatus may be implemented by products of various types, such as speakers (e.g., bone conduction speakers), bracelets, glasses, helmets, watches, clothings, or backpacks. For illustration purposes, a bone conduction speaker and a pair of glasses with a sound output function may be provided as an example of the acoustic output apparatus. Exemplary glasses may include myopia glasses, sports glasses, hyperopia glasses, reading glasses, astigmatism lenses, wind/sand-proof glasses, sunglasses, ultraviolet-proof glasses, welding mirrors, infrared-proof mirrors, and virtual reality (VR) glasses, augmented Reality (AR) glasses, mixed reality (MR) glasses, mediated reality glasses, or the like, or any combination thereof.

Figure 1:
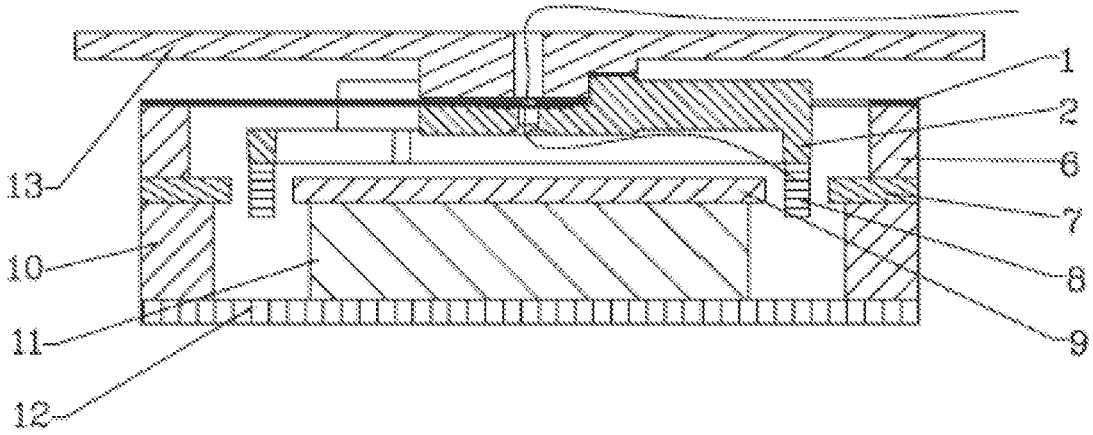
FIG. 1 illustrates a longitudinal section view of the bone conduction speaker in the present disclosure.
Figure 2:
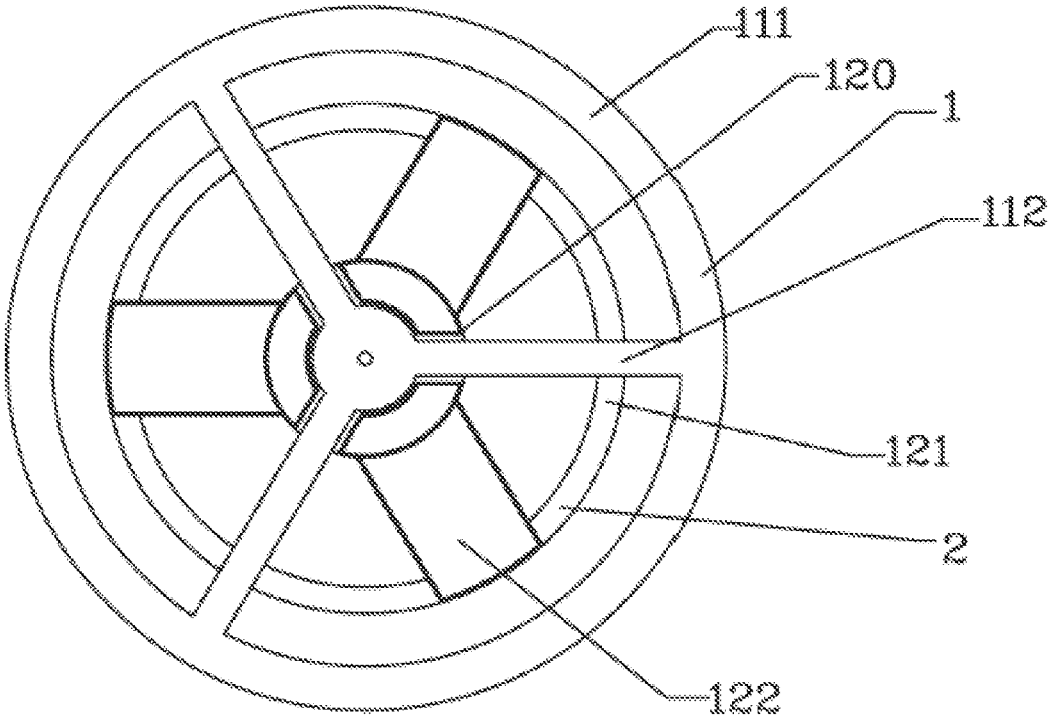
FIG. 2 illustrates a perspective view of the vibration parts in the bone conduction speaker in the present disclosure.
Figure 3:
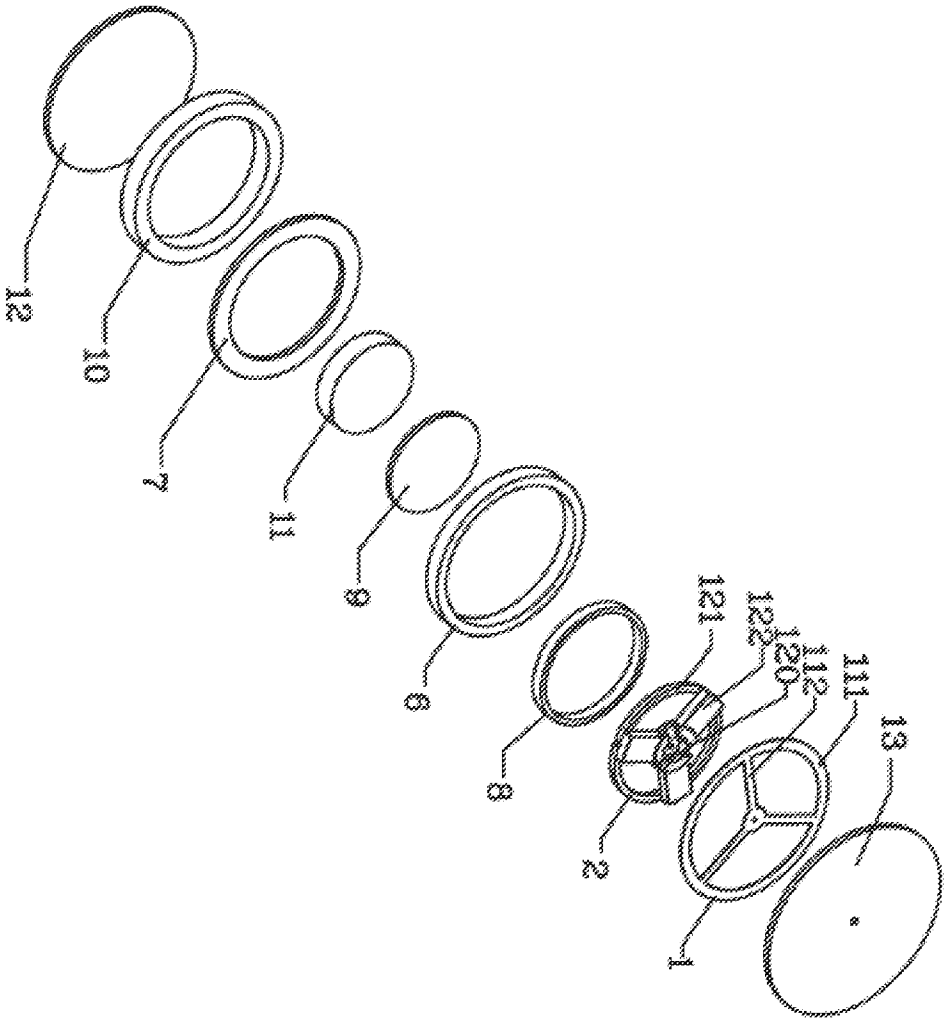
FIG. 3 illustrates an exploded perspective view of the bone conduction speaker in the present disclosure.

As shown in FIG. 1 and FIG. 3, the compound vibration device in the present disclosure of bone conduction speaker, comprises: the compound vibration parts composed of vibration conductive plate 1 and vibration board 2, the vibration conductive plate 1 is set as the first torus 111 and three first rods 112 in the first torus converging to the center of the torus, the converging center is fixed with the center of the vibration board 2. The center of the vibration board 2 is an indentation 120, which matches the converging center and the first rods. The vibration board 2 contains a second torus 121, which has a smaller radius than the vibration conductive plate 1, as well as three second rods 122, which is thicker and wider than the first rods 112. The first rods 112 and the second rods 122 are staggered. In some embodiments, a staggered angle between one of the first rods 112 and one of the second rods 122 may be a predetermined angle. For example, the predetermined angle may include but not limited to an angle of 60 degrees, as shown in FIG. 2. A better solution is, both the first and second rods are all straight rods.

Obviously the number of the first and second rods can be more than two, for example, if there are two rods, they can be set in a symmetrical position; however, the most economic design is working with three rods. Not limited to this rods setting mode, the setting of rods in the present disclosure can also be a spoke structure with four, five or more rods.

The vibration conductive plate 1 is very thin and can be more elastic, which is stuck at the center of the indentation 120 of the vibration board 2. Below the second torus 121 spliced in vibration board 2 is a voice coil 8. The compound vibration device in the present disclosure also comprises a bottom plate 12, where an annular magnet 10 is set, and an inner magnet 11 is set in the annular magnet 10 concentrically. An inner magnet conduction plate 9 is set on the top of the inner magnet 11, while annular magnet conduction plate 7 is set on the annular magnet 10, a grommet 6 is fixed above the annular magnet conduction plate 7, the first torus 111 of the vibration conductive plate 1 is fixed with the grommet 6. The whole compound vibration device is connected to the outside through a panel 13, the panel 13 is fixed with the vibration conductive plate 1 on its converging center, stuck and fixed at the center of both vibration conductive plate 1 and vibration board 2.

It should be noted that, both the vibration conductive plate and the vibration board can be set more than one, fixed with each other through either the center or staggered with both center and edge, forming a multilayer vibration structure, corresponding to different frequency resonance ranges, thus achieve a high tone quality earphone vibration unit with a gamut and full frequency range, despite of the higher cost.

The bone conduction speaker contains a magnet system, composed of the annular magnet conductive plate 7, annular magnet 10, bottom plate 12, inner magnet 11 and inner magnet conductive plate 9, because the changes of audio-frequency current in the voice coil 8 cause changes of magnet field, which makes the voice coil 8 vibrate. The compound vibration device is connected to the magnet system through grommet 6. The bone conduction speaker connects with the outside through the panel 13, being able to transfer vibrations to human bones.

Figure 6:
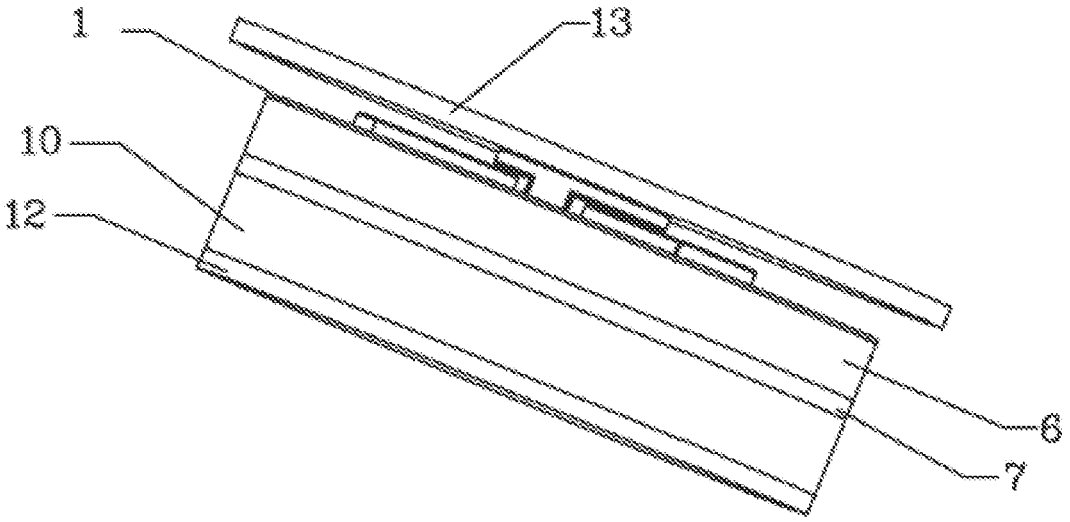
FIG. 6 illustrates a perspective view of the bone conduction speaker in the present disclosure.

In the better implement examples of the present bone conduction speaker and its compound vibration device, the magnet system, composed of the annular magnet conductive plate 7, annular magnet 10, inner magnet conduction plate 9, inner magnet 11 and bottom plate 12, interacts with the voice coil which generates changing magnet field intensity when its current is changing, and inductance changes accordingly, forces the voice coil 8 move longitudinally, then causes the vibration board 2 to vibrate, transfers the vibration to the vibration conductive plate 1, then, through the contact between panel 13 and the post ear, cheeks or forehead of the human beings, transfers the vibrations to human bones, thus generates sounds. A complete product unit is shown in FIG. 6.

Figure 5:
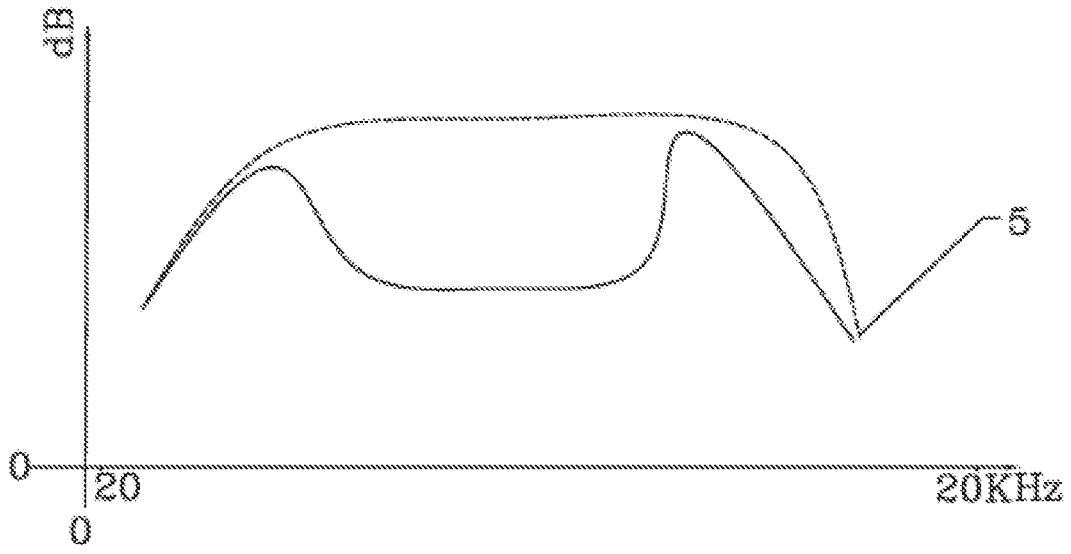
FIG. 5 illustrates a frequency response curves of the bone conduction speakers of the vibration device in the present disclosure.

Through the compound vibration device composed of the vibration board and the vibration conductive plate, a frequency response shown in FIG. 5 is achieved. The double compound vibration generates two resonance peaks, whose positions can be changed by adjusting the parameters including sizes and materials of the two vibration parts, making the resonance peak in low frequency area move to the lower frequency area and the peak in high frequency move higher, finally generates a frequency response curve as the dotted line shown in FIG. 5, which is a flat frequency response curve generated in an ideal condition, whose resonance peaks are among the frequencies catchable with human ears. Thus, the device widens the resonance oscillation ranges, and generates the ideal voices.

In some embodiments, the stiffness of the vibration board may be larger than that of the vibration conductive plate. In some embodiments, the resonance peaks of the frequency response curve may be set within a frequency range perceivable by human ears, or a frequency range that a person's ears may not hear. Preferably, the two resonance peaks may be beyond the frequency range that a person may hear. More preferably, one resonance peak may be within the frequency range perceivable by human ears, and another one may be beyond the frequency range that a person may hear. More preferably, the two resonance peaks may be within the frequency range perceivable by human ears. Further preferably, the two resonance peaks may be within the frequency range perceivable by human ears, and the peak frequency may be in a range of 80 Hz-18000 Hz. Further preferably, the two resonance peaks may be within the frequency range perceivable by human ears, and the peak frequency may be in a range of 200 Hz-15000 Hz. Further preferably, the two resonance peaks may be within the frequency range perceivable by human ears, and the peak frequency may be in a range of 500 Hz-12000 Hz. Further preferably, the two resonance peaks may be within the frequency range perceivable by human ears, and the peak frequency may be in a range of 800 Hz-11000 Hz. There may be a difference between the frequency values of the resonance peaks. For example, the difference between the frequency values of the two resonance peaks may be at least 500 Hz, preferably 1000 Hz, more preferably 2000 Hz, and more preferably 5000 Hz. To achieve a better effect, the two resonance peaks may be within the frequency range perceivable by human ears, and the difference between the frequency values of the two resonance peaks may be at least 500 Hz. Preferably, the two resonance peaks may be within the frequency range perceivable by human ears, and the difference between the frequency values of the two resonance peaks may be at least 1000 Hz. More preferably, the two resonance peaks may be within the frequency range perceivable by human ears, and the difference between the frequency values of the two resonance peaks may be at least 2000 Hz. More preferably, the two resonance peaks may be within the frequency range perceivable by human ears, and the difference between the frequency values of the two resonance peaks may be at least 3000 Hz. Moreover, more preferably, the two resonance peaks may be within the frequency range perceivable by human ears, and the difference between the frequency values of the two resonance peaks may be at least 4000 Hz. One resonance peak may be within the frequency range perceivable by human ears, another one may be beyond the frequency range that a person may hear, and the difference between the frequency values of the two resonance peaks may be at least 500 Hz. Preferably, one resonance peak may be within the frequency range perceivable by human ears, another one may be beyond the frequency range that a person may hear, and the difference between the frequency values of the two resonance peaks may be at least 1000 Hz. More preferably, one resonance peak may be within the frequency range perceivable by human ears, another one may be beyond the frequency range that a person may hear, and the difference between the frequency values of the two resonance peaks may be at least 2000 Hz. More preferably, one resonance peak may be within the frequency range perceivable by human ears, another one may be beyond the frequency range that a person may hear, and the difference between the frequency values of the two resonance peaks may be at least 3000 Hz. Moreover, more preferably, one resonance peak may be within the frequency range perceivable by human ears, another one may be beyond the frequency range that a person may hear, and the difference between the frequency values of the two resonance peaks may be at least 4000 Hz. Both resonance peaks may be within the frequency range of 5 Hz-30000 Hz, and the difference between the frequency values of the two resonance peaks may be at least 400 Hz. Preferably, both resonance peaks may be within the frequency range of 5 Hz-30000 Hz, and the difference between the frequency values of the two resonance peaks may be at least 1000 Hz. More preferably, both resonance peaks may be within the frequency range of 5 Hz-30000 Hz, and the difference between the frequency values of the two resonance peaks may be at least 2000 Hz. More preferably, both resonance peaks may be within the frequency range of 5 Hz-30000 Hz, and the difference between the frequency values of the two resonance peaks may be at least 3000 Hz. Moreover, further preferably, both resonance peaks may be within the frequency range of 5 Hz-30000 Hz, and the difference between the frequency values of the two resonance peaks may be at least 4000 Hz. Both resonance peaks may be within the frequency range of 20 Hz-20000 Hz, and the difference between the frequency values of the two resonance peaks may be at least 400 Hz. Preferably, both resonance peaks may be within the frequency range of 20 Hz-20000 Hz, and the difference between the frequency values of the two resonance peaks may be at least 1000 Hz. More preferably, both resonance peaks may be within the frequency range of 20 Hz-20000 Hz, and the difference between the frequency values of the two resonance peaks may be at least 2000 Hz. More preferably, both resonance peaks may be within the frequency range of 20 Hz-20000 Hz, and the difference between the frequency values of the two resonance peaks may be at least 3000 Hz. And further preferably, both resonance peaks may be within the frequency range of 20 Hz-20000 Hz, and the difference between the frequency values of the two resonance peaks may be at least 4000 Hz. Both the two resonance peaks may be within the frequency range of 100 Hz-18000 Hz, and the difference between the frequency values of the two resonance peaks may be at least 400 Hz. Preferably, both resonance peaks may be within the frequency range of 100 Hz-18000 Hz, and the difference between the frequency values of the two resonance peaks may be at least 1000 Hz. More preferably, both resonance peaks may be within the frequency range of 100 Hz-18000 Hz, and the difference between the frequency values of the two resonance peaks may be at least 2000 Hz. More preferably, both resonance peaks may be within the frequency range of 100 Hz-18000 Hz, and the difference between the frequency values of the two resonance peaks may be at least 3000 Hz. And further preferably, both resonance peaks may be within the frequency range of 100 Hz-18000 Hz, and the difference between the frequency values of the two resonance peaks may be at least 4000 Hz. Both the two resonance peaks may be within the frequency range of 200 Hz-12000 Hz, and the difference between the frequency values of the two resonance peaks may be at least 400 Hz. Preferably, both resonance peaks may be within the frequency range of 200 Hz-12000 Hz, and the difference between the frequency values of the two resonance peaks may be at least 1000 Hz. More preferably, both resonance peaks may be within the frequency range of 200 Hz-12000 Hz, and the difference between the frequency values of the two resonance peaks may be at least 2000 Hz. More preferably, both resonance peaks may be within the frequency range of 200 Hz-12000 Hz, and the difference between the frequency values of the two resonance peaks may be at least 3000 Hz. And further preferably, both resonance peaks may be within the frequency range of 200 Hz-12000 Hz, and the difference between the frequency values of the two resonance peaks may be at least 4000 Hz. Both the two resonance peaks may be within the frequency range of 500 Hz-10000 Hz, and the difference between the frequency values of the two resonance peaks may be at least 400 Hz. Preferably, both resonance peaks may be within the frequency range of 500 Hz-10000 Hz, and the difference between the frequency values of the two resonance peaks may be at least 1000 Hz. More preferably, both resonance peaks may be within the frequency range of 500 Hz-10000 Hz, and the difference between the frequency values of the two resonance peaks may be at least 2000 Hz. More preferably, both resonance peaks may be within the frequency range of 500 Hz-10000 Hz, and the difference between the frequency values of the two resonance peaks may be at least 3000 Hz. And further preferably, both resonance peaks may be within the frequency range of 500 Hz-10000 Hz, and the difference between the frequency values of the two resonance peaks may be at least 4000 Hz. This may broaden the range of the resonance response of the speaker, thus obtaining a more ideal sound quality. It should be noted that in actual applications, there may be multiple vibration conductive plates and vibration boards to form multi-layer vibration structures corresponding to different ranges of frequency response, thus obtaining diatonic, full-ranged and high-quality vibrations of the speaker, or may make the frequency response curve meet requirements in a specific frequency range. For example, to satisfy the requirement of normal hearing, a bone conduction hearing aid may be configured to have a transducer including one or more vibration boards and vibration conductive plates with a resonance frequency in a range of 100 Hz-10000 Hz.

In the better implement examples, but, not limited to these examples, it is adopted that, the vibration conductive plate can be made by stainless steels, with a thickness of 0.1-0.2 mm, and when the middle three rods of the first rods group in the vibration conductive plate have a width of 0.5-1.0 mm, the low frequency resonance oscillation peak of the bone conduction speaker is located between 300 and 900 Hz. And, when the three straight rods in the second rods group have a width between 1.6 and 2.6 mm, and a thickness between 0.8 and 1.2 mm, the high frequency resonance oscillation peak of the bone conduction speaker is between 7500 and 9500 Hz. Also, the structures of the vibration conductive plate and the vibration board is not limited to three straight rods, as long as their structures can make a suitable flexibility to both vibration conductive plate and vibration board, cross-shaped rods and other rod structures are also suitable. Of course, with more compound vibration parts, more resonance oscillation peaks will be achieved, and the fitting curve will be flatter and the sound wider. Thus, in the better implement examples, more than two vibration parts, including the vibration conductive plate and vibration board as well as similar parts, overlapping each other, is also applicable, just needs more costs.

Figure 7:
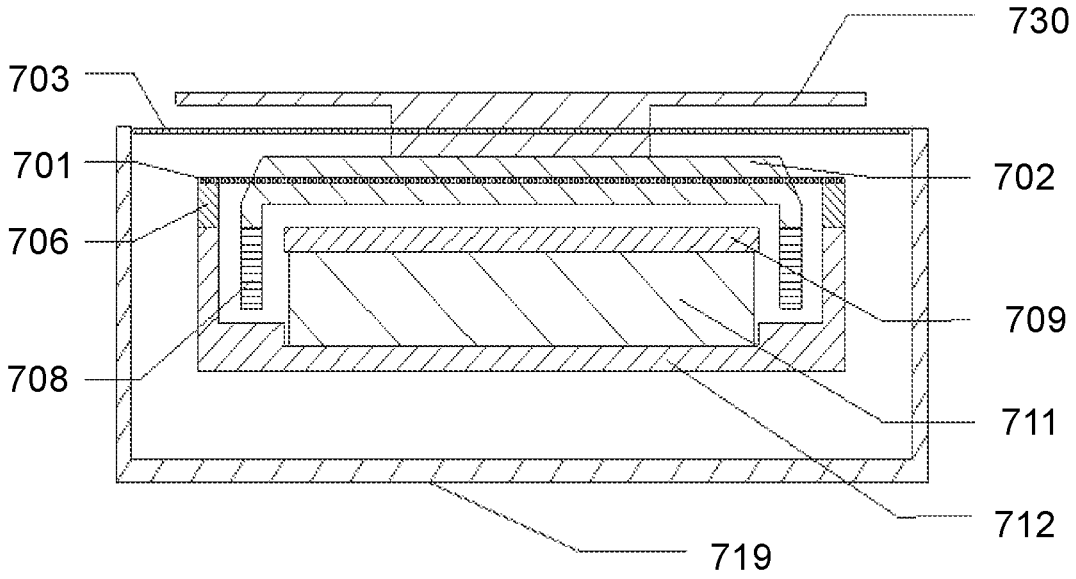
FIG. 7 illustrates a structure of the bone conduction speaker and the compound vibration device according to some embodiments of the present disclosure.

As shown in FIG. 7, in another embodiment, the compound vibration device (also referred to as "compound vibration system") may include a vibration board 702, a first vibration conductive plate 703, and a second vibration conductive plate 701. The first vibration conductive plate 703 may fix the vibration board 702 and the second vibration conductive plate 701 onto a housing 719. The compound vibration system including the vibration board 702, the first vibration conductive plate 703, and the second vibration conductive plate 701 may lead to no less than two resonance peaks and a smoother frequency response curve in the range of the auditory system, thus improving the sound quality of the bone conduction speaker. The equivalent model of the compound vibration system may be shown in FIG. 8-A:

For illustration purposes, 801 represents a housing, 802 represents a panel, 803 represents a voice coil, 804 represents a magnetic circuit system, 805 represents a first vibration conductive plate, 806 represents a second vibration conductive plate, and 807 represents a vibration board. The first vibration conductive plate, the second vibration conductive plate, and the vibration board may be abstracted as components with elasticity and damping; the housing, the panel, the voice coil and the magnetic circuit system may be abstracted as equivalent mass blocks. The vibration equation of the system may be expressed as:

$$m_6x_6''+R_6(x_6-x_5)'+k_6(x_6-x_5)=F, \tag{1}$$

$$x_7''+R_7(x_7-x_5)'+k_7(x_7-x_5)=-F, \tag{2}$$

$$m_5x_5''-R_6(x_6-x_5)'-R_7(x_7-x_5)'+R_8x_5'+k_8x_5-k_6(x_6-x_5)-k_7(x_7-x_5)=0, \tag{3}$$

wherein, F is a driving force, $k_6$ is an equivalent stiffness coefficient of the second vibration conductive plate, $k_7$ is an equivalent stiffness coefficient of the vibration board, $k_8$ is an equivalent stiffness coefficient of the first vibration conductive plate, $R_6$ is an equivalent damping of the second vibration conductive plate, $R_7$ is an equivalent damping of the vibration board, $R_8$ is an equivalent damp of the first vibration conductive plate, $m_5$ is a mass of the panel, $m_6$ is a mass of the magnetic circuit system, $m_7$ is a mass of the voice coil, $x_5$ is a displacement of the panel, $x_6$ is a displacement of the magnetic circuit system, $x_7$ is to displacement of the voice coil, and the amplitude of the panel 802 may be:

$$A_5=-\frac{\left(-m_6\omega^2(jR_7\omega-k_7)+m_7\omega^2(jR_6\omega-k_6)\right)}{\begin{pmatrix}(-m_5\omega^2-jR_8\omega+k_8)(-m_6\omega^2-jR_6\omega+k_6)\\(-m_7\omega^2-jR_7\omega+k_7)\\-m_6\omega^2(-jR_6\omega+k_6)(-m_7\omega^2-jR_7\omega+k_7)\\-m_7\omega^2(-jR_7\omega+k_7)(-m_6\omega^2-jR_6\omega+k_6)\end{pmatrix}}f_0, \tag{4}$$

wherein ω is an angular frequency of the vibration, and $f_0$ is a unit driving force.

The vibration system of the bone conduction speaker may transfer vibrations to a user via a panel (e.g., the panel 730 shown in FIG. 7). According to the equation (4), the vibration efficiency may relate to the stiffness coefficients of the vibration board, the first vibration conductive plate, and the second vibration conductive plate, and the vibration damping. Preferably, the stiffness coefficient of the vibration board $k_7$ may be greater than the second vibration coefficient $k_6$, and the stiffness coefficient of the vibration board $k_7$ may be greater than the first vibration factor $k_8$. The number of resonance peaks generated by the compound vibration system with the first vibration conductive plate may be more than the compound vibration system without the first vibration conductive plate, preferably at least three resonance peaks. More preferably, at least one resonance peak may be beyond the range perceivable by human ears. More preferably, the resonance peaks may be within the range perceivable by human ears. More further preferably, the resonance peaks may be within the range perceivable by human ears, and the frequency peak value may be no more than 18000 Hz. More preferably, the resonance peaks may be within the range perceivable by human ears, and the frequency peak value may be within the frequency range of 100 Hz-15000 Hz. More preferably, the resonance peaks may be within the range perceivable by human ears, and the frequency peak value may be within the frequency range of 200 Hz-12000 Hz. More preferably, the resonance peaks may be within the range perceivable by human ears, and the frequency peak value may be within the frequency range of 500 Hz-11000 Hz. There may be differences between the frequency values of the resonance peaks. For example, there may be at least two resonance peaks with a difference of the frequency values between the two resonance peaks no less than 200 Hz. Preferably, there may be at least two resonance peaks with a difference of the frequency values between the two resonance peaks no less than 500 Hz. More preferably, there may be at least two resonance peaks with a difference of the frequency values between the two resonance peaks no less than 1000 Hz. More preferably, there may be at least two resonance peaks with a difference of the frequency values between the two resonance peaks no less than 2000 Hz. More preferably, there may be at least two resonance peaks with a difference of the frequency values between the two resonance peaks no less than 5000 Hz. To achieve a better effect, all of the resonance peaks may be within the range perceivable by human ears, and there may be at least two resonance peaks with a difference of the frequency values between the two resonance peaks no less than 500 Hz. Preferably, all of the resonance peaks may be within the range perceivable by human ears, and there may be at least two resonance peaks with a difference of the frequency values between the two resonance peaks no less than 1000 Hz. More preferably, all of the resonance peaks may be within the range perceivable by human ears, and there may be at least two resonance peaks with a difference of the frequency values between the two resonance peaks no less than 2000 Hz. More preferably, all of the resonance peaks may be within the range perceivable by human ears, and there may be at least two resonance peaks with a difference of the frequency values between the two resonance peaks no less than 3000 Hz. More preferably, all of the resonance peaks may be within the range perceivable by human ears, and there may be at least two resonance peaks with a difference of the frequency values between the two resonance peaks no less than 4000 Hz. Two of the three resonance peaks may be within the frequency range perceivable by human ears, and another one may be beyond the frequency range that a person may hear, and there may be at least two resonance peaks with a difference of the frequency values between the two resonance peaks no less than 500 Hz. Preferably, two of the three resonance peaks may be within the frequency range perceivable by human ears, and another one may be beyond the frequency range that a person may hear, and there may be at least two resonance peaks with a difference of the frequency values between the two resonance peaks no less than 1000 Hz. More preferably, two of the three resonance peaks may be within the frequency range perceivable by human ears, and another one may be beyond the frequency range that a person may hear, and there may be at least two resonance peaks with a difference of the frequency values between the two resonance peaks no less than 2000 Hz. More preferably, two of the three resonance peaks may be within the frequency range perceivable by human ears, and another one may be beyond the frequency range that a person may hear, and there may be at least two resonance peaks with a difference of the frequency values between the two resonance peaks no less than 3000 Hz. More preferably, two of the three resonance peaks may be within the frequency range perceivable by human ears, and another one may be beyond the frequency range that a person may hear, and there may be at least two resonance peaks with a difference of the frequency values between the two resonance peaks no less than 4000 Hz. One of the three resonance peaks may be within the frequency range perceivable by human ears, and the other two may be beyond the frequency range that a person may hear, and there may be at least two resonance peaks with a difference of the frequency values between the two resonance peaks no less than 500 Hz. Preferably, one of the three resonance peaks may be within the frequency range perceivable by human ears, and the other two may be beyond the frequency range that a person may hear, and there may be at least two resonance peaks with a difference of the frequency values between the two resonance peaks no less than 1000 Hz. More preferably, one of the three resonance peaks may be within the frequency range perceivable by human ears, and the other two may be beyond the frequency range that a person may hear, and there may be at least two resonance peaks with a difference of the frequency values between the two resonance peaks no less than 2000 Hz. More preferably, one of the three resonance peaks may be within the frequency range perceivable by human ears, and the other two may be beyond the frequency range that a person may hear, and there may be at least two resonance peaks with a difference of the frequency values between the two resonance peaks no less than 3000 Hz. More preferably, one of the three resonance peaks may be within the frequency range perceivable by human ears, and the other two may be beyond the frequency range that a person may hear, and there may be at least two resonance peaks with a difference of the frequency values between the two resonance peaks no less than 4000 Hz. All the resonance peaks may be within the frequency range of 5 Hz-30000 Hz, and there may be at least two resonance peaks with a difference of the frequency values between the two resonance peaks of at least 400 Hz. Preferably, all the resonance peaks may be within the frequency range of 5 Hz-30000 Hz, and there may be at least two resonance peaks with a difference of the frequency values between the two resonance peaks of at least 1000 Hz. More preferably, all the resonance peaks may be within the frequency range of 5 Hz-30000 Hz, and there may be at least two resonance peaks with a difference of the frequency values between the two resonance peaks of at least 2000 Hz. More preferably, all the resonance peaks may be within the frequency range of 5 Hz-30000 Hz, and there may be at least two resonance peaks with a difference of the frequency values between the two resonance peaks of at least 3000 Hz. And further preferably, all the resonance peaks may be within the frequency range of 5 Hz-30000 Hz, and there may be at least two resonance peaks with a difference of the frequency values between the two resonance peaks of at least 4000 Hz. All the resonance peaks may be within the frequency range of 20 Hz-20000 Hz, and there may be at least two resonance peaks with a difference of the frequency values between the two resonance peaks of at least 400 Hz. Preferably, all the resonance peaks may be within the frequency range of 20 Hz-20000 Hz, and there may be at least two resonance peaks with a difference of the frequency values between the two resonance peaks of at least 1000 Hz. More preferably, all the resonance peaks may be within the frequency range of 20 Hz-20000 Hz, and there may be at least two resonance peaks with a difference of the frequency values between the two resonance peaks of at least 2000 Hz. More preferably, all the resonance peaks may be within the frequency range of 20 Hz-20000 Hz, and there may be at least two resonance peaks with a difference of the frequency values between the two resonance peaks of at least 3000 Hz. And further preferably, all the resonance peaks may be within the frequency range of 20 Hz-20000 Hz, and there may be at least two resonance peaks with a difference of the frequency values between the two resonance peaks of at least 4000 Hz. All the resonance peaks may be within the frequency range of 100 Hz-18000 Hz, and there may be at least two resonance peaks with a difference of the frequency values between the two resonance peaks of at least 400 Hz. Preferably, all the resonance peaks may be within the frequency range of 100 Hz-18000 Hz, and there may be at least two resonance peaks with a difference of the frequency values between the two resonance peaks of at least 1000 Hz. More preferably, all the resonance peaks may be within the frequency range of 100 Hz-18000 Hz, and there may be at least two resonance peaks with a difference of the frequency values between the two resonance peaks of at least 2000 Hz. More preferably, all the resonance peaks may be within the frequency range of 100 Hz-18000 Hz, and there may be at least two resonance peaks with a difference of the frequency values between the two resonance peaks of at least 3000 Hz. And further preferably, all the resonance peaks may be within the frequency range of 100 Hz-18000 Hz, and there may be at least two resonance peaks with a difference of the frequency values between the two resonance peaks of at least 4000 Hz. All the resonance peaks may be within the frequency range of 200 Hz-12000 Hz, and there may be at least two resonance peaks with a difference of the frequency values between the two resonance peaks of at least 400 Hz. Preferably, all the resonance peaks may be within the frequency range of 200 Hz-12000 Hz, and there may be at least two resonance peaks with a difference of the frequency values between the two resonance peaks of at least 1000 Hz. More preferably, all the resonance peaks may be within the frequency range of 200 Hz-12000 Hz, and there may be at least two resonance peaks with a difference of the frequency values between the two resonance peaks of at least 2000 Hz. More preferably, all the resonance peaks may be within the frequency range of 200 Hz-12000 Hz, and there may be at least two resonance peaks with a difference of the frequency values between the two resonance peaks of at least 3000 Hz. And further preferably, all the resonance peaks may be within the frequency range of 200 Hz-12000 Hz, and there may be at least two resonance peaks with a difference of the frequency values between the two resonance peaks of at least 4000 Hz. All the resonance peaks may be within the frequency range of 500 Hz-10000 Hz, and there may be at least two resonance peaks with a difference of the frequency values between the two resonance peaks of at least 400 Hz. Preferably, all the resonance peaks may be within the frequency range of 500 Hz-10000 Hz, and there may be at least two resonance peaks with a difference of the frequency values between the two resonance peaks of at least 1000 Hz. More preferably, all the resonance peaks may be within the frequency range of 500 Hz-10000 Hz, and there may be at least two resonance peaks with a difference of the frequency values between the two resonance peaks of at least 2000 Hz. More preferably, all the resonance peaks may be within the frequency range of 500 Hz-10000 Hz, and there may be at least two resonance peaks with a difference of the frequency values between the two resonance peaks of at least 3000 Hz. Moreover, further preferably, all the resonance peaks may be within the frequency range of 500 Hz-10000 Hz, and there may be at least two resonance peaks with a difference of the frequency values between the two resonance peaks of at least 4000 Hz. In one embodiment, the compound vibration system including the vibration board, the first vibration conductive plate, and the second vibration conductive plate may generate a frequency response as shown in FIG. 8-B. The compound vibration system with the first vibration conductive plate may generate three obvious resonance peaks, which may improve the sensitivity of the frequency response in the low-frequency range (about 600 Hz), obtain a smoother frequency response, and improve the sound quality.

The resonance peak may be shifted by changing a parameter of the first vibration conductive plate, such as the size and material, so as to obtain an ideal frequency response eventually. For example, the stiffness coefficient of the first vibration conductive plate may be reduced to a designed value, causing the resonance peak to move to a designed low frequency, thus enhancing the sensitivity of the bone conduction speaker in the low frequency, and improving the quality of the sound. As shown in FIG. 8-C, as the stiffness coefficient of the first vibration conductive plate decreases (i.e., the first vibration conductive plate becomes softer), the resonance peak moves to the low frequency region, and the sensitivity of the frequency response of the bone conduction speaker in the low frequency region gets improved. Preferably, the first vibration conductive plate may be an elastic plate, and the elasticity may be determined based on the material, thickness, structure, or the like. The material of the first vibration conductive plate may include but not limited to steel (for example but not limited to, stainless steel, carbon steel, etc.), light alloy (for example but not limited to, aluminum, beryllium copper, magnesium alloy, titanium alloy, etc.), plastic (for example but not limited to, polyethylene, nylon blow molding, plastic, etc.). It may be a single material or a composite material that achieve the same performance. The composite material may include but not limited to reinforced material, such as glass fiber, carbon fiber, boron fiber, graphite fiber, graphene fiber, silicon carbide fiber, aramid fiber, or the like. The composite material may also be other organic and/or inorganic composite materials, such as various types of glass fiber reinforced by unsaturated polyester and epoxy, fiberglass comprising phenolic resin matrix. The thickness of the first vibration conductive plate may be not less than 0.005 mm. Preferably, the thickness may be 0.005 mm-3 mm. More preferably, the thickness may be 0.01 mm-2 mm. More preferably, the thickness may be 0.01 mm-1 mm. Moreover, further preferably, the thickness may be 0.02 mm-0.5 mm. The first vibration conductive plate may have an annular structure, preferably including at least one annular ring, preferably, including at least two annular rings. The annular ring may be a concentric ring or a non-concentric ring and may be connected to each other via at least two rods converging from the outer ring to the center of the inner ring. More preferably, there may be at least one oval ring. More preferably, there may be at least two oval rings. Different oval rings may have different curvatures radiuses, and the oval rings may be connected to each other via rods. Further preferably, there may be at least one square ring. The first vibration conductive plate may also have the shape of a plate. Preferably, a hollow pattern may be configured on the plate. Moreover, more preferably, the area of the hollow pattern may be not less than the area of the non-hollow portion. It should be noted that the above-described material, structure, or thickness may be combined in any manner to obtain different vibration conductive plates. For example, the annular vibration conductive plate may have a different thickness distribution. Preferably, the thickness of the ring may be equal to the thickness of the rod. Further preferably, the thickness of the rod may be larger than the thickness of the ring. Moreover, still, further preferably, the thickness of the inner ring may be larger than the thickness of the outer ring.

When the compound vibration device is applied to the bone conduction speaker, the major applicable area is bone conduction earphones. Thus the bone conduction speaker adopting the structure will be fallen into the protection of the present disclosure.

The bone conduction speaker and its compound vibration device stated in the present disclosure, make the technique simpler with a lower cost. Because the two parts in the compound vibration device can adjust the low frequency as well as the high frequency ranges, as shown in FIG. 5, which makes the achieved frequency response flatter, and voice more broader, avoiding the problem of abrupt frequency response and feeble voices caused by single vibration device, thus broaden the application prospection of bone conduction speaker.

Figure 4:
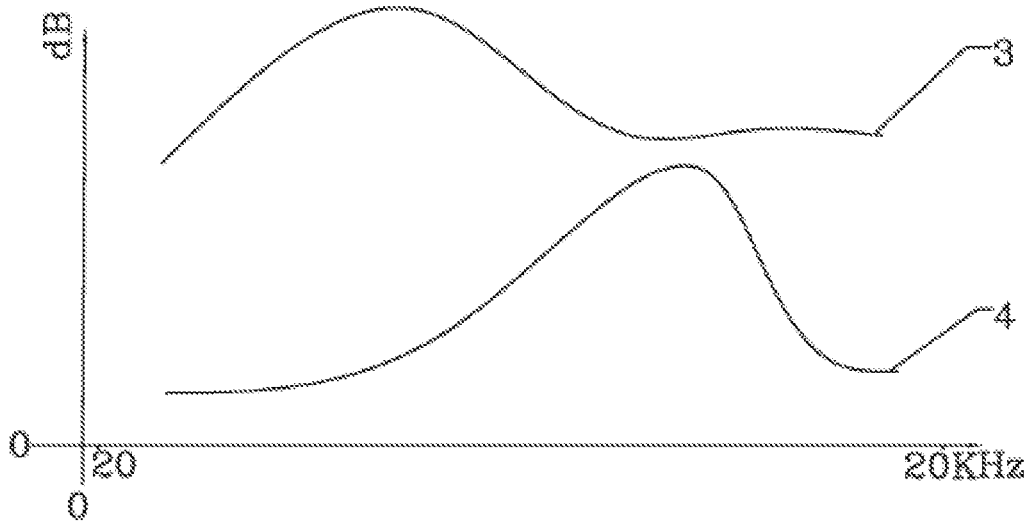
FIG. 4 illustrates a frequency response curves of the bone conduction speakers of vibration device in the prior art.

In the prior art, the vibration parts did not take full account of the effects of every part to the frequency response, thus, although they could have the similar outlooks with the products described in the present disclosure, they will generate an abrupt frequency response, or feeble sound. And due to the improper matching between different parts, the resonance peak could have exceeded the human hearable range, which is between 20 Hz and 20 KHz. Thus, only one sharp resonance peak as shown in FIG. 4 appears, which means a pretty poor tone quality.

It should be made clear that, the above detailed description of the better implement examples should not be considered as the limitations to the present disclosure protections. The extent of the patent protection of the present disclosure should be determined by the terms of claims.

EXAMPLES

Example 1

A bone conduction speaker may include a U-shaped headset bracket/headset lanyard, two vibration units, a transducer connected to each vibration unit. The vibration unit may include a contact surface and a housing. The contact surface may be an outer surface of a silicone rubber transfer layer and may be configured to have a gradient structure including a convex portion. A clamping force between the contact surface and skin due to the headset bracket/headset lanyard may be unevenly distributed on the contact surface. The sound transfer efficiency of the portion of the gradient structure may be different from the portion without the gradient structure.

Example 2

This example may be different from Example 1 in the following aspects. The headset bracket/headset lanyard as described may include a memory alloy. The headset bracket/headset lanyard may match the curves of different users' heads and have a good elasticity and a better wearing comfort. The headset bracket/headset lanyard may recover to its original shape from a deformed status last for a certain period. As used herein, the certain period may refer to ten minutes, thirty minutes, one hour, two hours, five hours, or may also refer to one day, two days, ten days, one month, one year, or a longer period. The clamping force that the headset bracket/headset lanyard provides may keep stable, and may not decline gradually over time. The force intensity between the bone conduction speaker and the body surface of a user may be within an appropriate range, so as to avoid pain or clear vibration sense caused by undue force when the user wears the bone conduction speaker. Moreover, the clamping force of bone conduction speaker may be within a range of 0.2 N~1.5 N when the bone conduction speaker is used.

Example 3

The difference between this example and the two examples mentioned above may include the following aspects. The elastic coefficient of the headset bracket/headset lanyard may be kept in a specific range, which results in the value of the frequency response curve in low frequency (e.g., under 500 Hz) being higher than the value of the frequency response curve in high frequency (e.g., above 4000 Hz).

Example 4

The difference between Example 4 and Example 1 may include the following aspects. The bone conduction speaker may be mounted on an eyeglass frame, or in a helmet or mask with a special function.

Example 5

The difference between this example and Example 1 may include the following aspects. The vibration unit may include two or more panels, and the different panels or the vibration transfer layers connected to the different panels may have different gradient structures on a contact surface being in contact with a user. For example, one contact surface may have a convex portion, the other one may have a concave structure, or the gradient structures on both the two contact surfaces may be convex portions or concave structures, but there may be at least one difference between the shape or the number of the convex portions.

Example 6

A portable bone conduction hearing aid may include multiple frequency response curves. A user or a tester may choose a proper response curve for hearing compensation according to an actual response curve of the auditory system of a person. In addition, according to an actual requirement, a vibration unit in the bone conduction hearing aid may enable the bone conduction hearing aid to generate an ideal frequency response in a specific frequency range, such as 500 Hz-4000 Hz.

Example 7

A vibration generation portion of a bone conduction speaker may be shown in FIG. 9-A. A transducer of the bone conduction speaker may include a magnetic circuit system including a magnetic flux conduction plate 910, a magnet 911 and a magnetizer 912, a vibration board 914, a coil 915, a first vibration conductive plate 916, and a second vibration conductive plate 917. The panel 913 may protrude out of the housing 919 and may be connected to the vibration board 914 by glue. The transducer may be fixed to the housing 919 via the first vibration conductive plate 916 forming a suspended structure.

A compound vibration system including the vibration board 914, the first vibration conductive plate 916, and the second vibration conductive plate 917 may generate a smoother frequency response curve, so as to improve the sound quality of the bone conduction speaker. The transducer may be fixed to the housing 919 via the first vibration conductive plate 916 to reduce the vibration that the transducer is transferring to the housing, thus effectively decreasing sound leakage caused by the vibration of the housing, and reducing the effect of the vibration of the housing on the sound quality. FIG. 9-B shows frequency response curves of the vibration intensities of the housing of the vibration generation portion and the panel. The bold line refers to the frequency response of the vibration generation portion including the first vibration conductive plate 916, and the thin line refers to the frequency response of the vibration generation portion without the first vibration conductive plate 916. As shown in FIG. 9-B, the vibration intensity of the housing of the bone conduction speaker without the first vibration conductive plate may be larger than that of the bone conduction speaker with the first vibration conductive plate when the frequency is higher than 500 Hz. FIG. 9-C shows a comparison of the sound leakage between a bone conduction speaker includes the first vibration conductive plate 916 and another bone conduction speaker does not include the first vibration conductive plate 916. The sound leakage when the bone conduction speaker includes the first vibration conductive plate may be smaller than the sound leakage when the bone conduction speaker does not include the first vibration conductive plate in the intermediate frequency range (for example, about 1000 Hz). It can be concluded that the use of the first vibration conductive plate between the panel and the housing may effectively reduce the vibration of the housing, thereby reducing the sound leakage.

The first vibration conductive plate may be made of the material, for example but not limited to stainless steel, copper, plastic, polycarbonate, or the like, and the thickness may be in a range of 0.01 mm-1 mm.

Example 8

Figure 10:
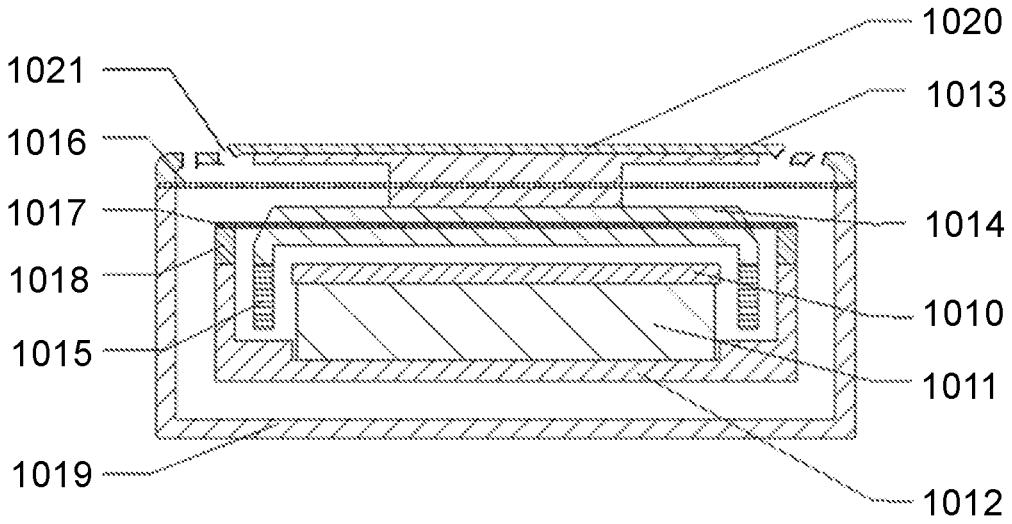
FIG. 10 illustrates a structure of the vibration generation portion of the bone conduction speaker according to one specific embodiment of the present disclosure.

This example may be different with Example 7 in the following aspects. As shown in FIG. 10, the panel 1013 may be configured to have a vibration transfer layer 1020 (for example but not limited to, silicone rubber) to produce a certain deformation to match a user's skin. A contact portion being in contact with the panel 1013 on the vibration transfer layer 1020 may be higher than a portion not being in contact with the panel 1013 on the vibration transfer layer 1020 to form a step structure. The portion not being in contact with the panel 1013 on the vibration transfer layer 1020 may be configured to have one or more holes 1021. The holes on the vibration transfer layer may reduce the sound leakage: the connection between the panel 1013 and the housing 1019 via the vibration transfer layer 1020 may be weakened, and vibration transferred from panel 1013 to the housing 1019 via the vibration transfer layer 1020 may be reduced, thereby reducing the sound leakage caused by the vibration of the housing; the area of the vibration transfer layer 1020 configured to have holes on the portion without protrusion may be reduced, thereby reducing air and sound leakage caused by the vibration of the air; the vibration of air in the housing may be guided out, interfering with the vibration of air caused by the housing 1019, thereby reducing the sound leakage.

Example 9

The difference between this example and Example 7 may include the following aspects. As the panel may protrude out of the housing, meanwhile, the panel may be connected to the housing via the first vibration conductive plate, the degree of coupling between the panel and the housing may be dramatically reduced, and the panel may be in contact with a user with a higher freedom to adapt complex contact surfaces (as shown in the right figure of FIG. 11-A) as the first vibration conductive plate provides a certain amount of deformation. The first vibration conductive plate may incline the panel relative to the housing with a certain angle. Preferably, the slope angle may not exceed 5 degrees.

The vibration efficiency may differ with contacting statuses. A better contacting status may lead to a higher vibration transfer efficiency. As shown in FIG. 11-B, the bold line shows the vibration transfer efficiency with a better contacting status, and the thin line shows a worse contacting status. It may be concluded that the better contacting status may correspond to a higher vibration transfer efficiency.

Example 10

Figure 12:
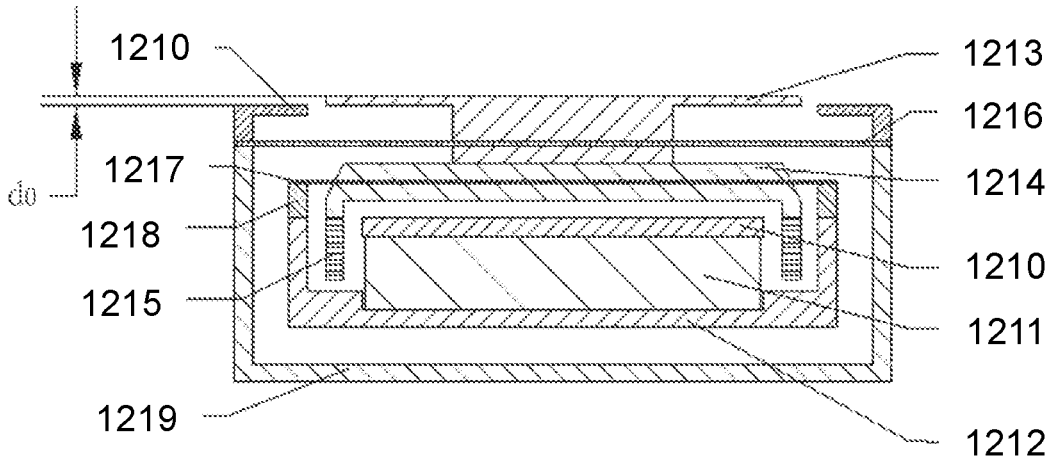
FIG. 12 illustrates a structure of the vibration generation portion of the bone conduction speaker according to one specific embodiment of the present disclosure.

The difference between this example and Example 7 may include the following aspects. A boarder may be added to surround the housing. When the housing contact with a user's skin, the surrounding boarder may facilitate an even distribution of an applied force, and improve the user's wearing comfort. As shown in FIG. 12, there may be a height difference do between the surrounding border 1210 and the panel 1213. The force from the skin to the panel 1213 may decrease the distanced between the panel 1213 and the surrounding border 1210. When the force between the bone conduction speaker and the user is larger than the force applied to the first vibration conductive plate with a deformation of do, the extra force may be transferred to the user's skin via the surrounding border 1210, without influencing the clamping force of the vibration portion, with the consistency of the clamping force improved, thereby ensuring the sound quality.

Example 11

Figure 13:
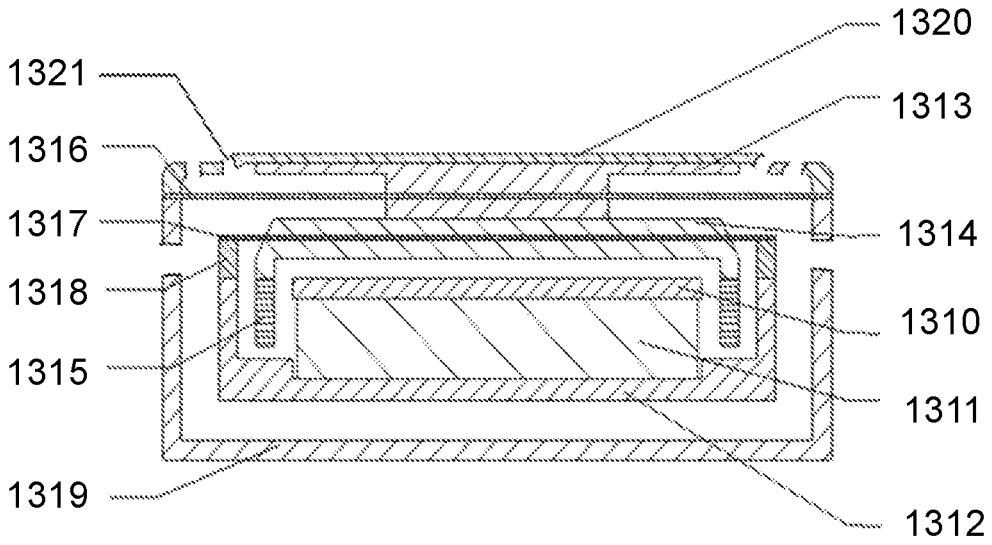
FIG. 13 illustrates a structure of the vibration generation portion of the bone conduction speaker according to one specific embodiment of the present disclosure.

The difference between this example and Example 8 may include the following aspects. As shown in FIG. 13, sound guiding holes are located at the vibration transfer layer 1320 and the housing 1319, respectively. The acoustic wave formed by the vibration of the air in the housing is guided to the outside of the housing, and interferes with the leaked acoustic wave due to the vibration of the air out of the housing, thus reducing the sound leakage.

It should be noted that the bone conduction speakers described above are only for illustration purposes, other acoustic output apparatus may have different structures. For example, an acoustic output apparatus may include a Bluetooth low energy (BLE) module configured to establish communication between the acoustic output apparatus and a terminal device of a user. As another example, the acoustic output apparatus may include at least one earphone core (e.g., an earphone core 1510) including at least one acoustic driver (e.g., the vibration device as described in FIGS. 1-13) for outputting sound through one or more sound guiding holes (e.g., sound guiding holes 1411 as described in FIG. 14) set on the acoustic output apparatus. As still another example, the acoustic output apparatus may include one or more sensors, a controller, a power source assembly, and a flexible circuit board. The one or more sensors may be configured to detect the status information of a user of the acoustic output apparatus. The controller may be configured to cause the vibration device to output sound based on the detected status information of the user. The power source assembly may be configured to provide electrical power to the at least earphone core (e.g., the vibration device thereof), the one or more sensors, and the controller. The flexible circuit board may be configured to connect the at least earphone core (e.g., the vibration device thereof) and the power source assembly. The BLE module may be integrated on a same circuit board with the controller and the at least earphone core. The circuit board may be connected to the power source assembly through the flexible circuit board. More descriptions regarding the acoustic output apparatus may be found elsewhere in the present disclosure (e.g., FIGS. 14-18 and relevant descriptions thereof).

Figure 14:
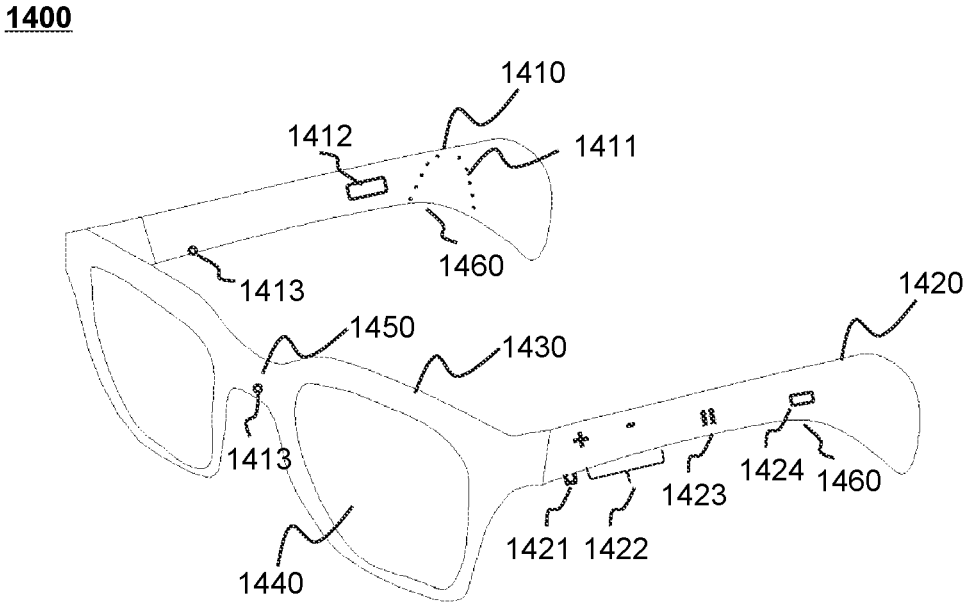
FIG. 14 is a schematic diagram illustrating an exemplary acoustic output apparatus embodied as glasses according to some embodiments of the present disclosure.

FIG. 14 is a schematic diagram illustrating an exemplary acoustic output apparatus embodied as glasses according to some embodiments of the present disclosure. As shown in FIG. 14, the glasses 1400 may include a frame and lenses 1440. The frame may include legs 1410 and 1420, a lens ring 1430, a nose pad 1450, or the like. The legs 1410 and 1420 may be used to support the lens ring 1430 and the lenses 1440, and fix the glasses 1400 on the user's face. The lens ring 1430 may be used to support the lenses 1440. The nose pad 1450 may be used to fix the glasses 1400 on the user's nose.

The glasses 1400 may be provided with a plurality of components which may implement different functions. Exemplary components may include a power source assembly for providing power, an acoustic driver for generating sound, a microphone for detecting external sound, a bluetooth module for connecting the glasses 1400 to other devices, a controller for controlling the operation of other components, or the like, or any combination thereof. In some embodiments, the interior of the leg 1410 and/or the leg 1420 may be provided as a hollow structure for accommodating the one or more components.

The glasses 1400 may be provided with a plurality of hollow structures. For example, as shown in FIG. 14, a side of the leg 1410 and/or the leg 1420 facing away from the user's face may be provided with sound guiding holes 1411. The sound guiding holes 1411 may be connected to one or more acoustic drivers that are set inside of the glasses 1400 to export sound produced by the one or more the acoustic drivers. In some embodiments, the sound guiding holes 1411 may be provided at a position near the user's ear on the leg 1410 and/or the leg 1420. For example, the sound guiding holes 1411 may be provided at a rear end of the leg 1410 and/or the leg 1420 being far away from the lens ring 1430, a bending part 1460 of the leg, or the like. As another example, the glasses 1400 may also have a power interface 1412, which may be used to charge the power source assembly in the glasses 1400. The power interface 1412 may be provided on a side of the leg 1410 and/or the leg 1420 facing the user's face. Exemplary power interfaces may include a dock charging interface, a DC charging interface, a USB charging interface, a lightning charging interface, a wireless charging interface, a magnetic charging interface, or the like, or any combination thereof. In some embodiments, one or more sound inlet holes 1413 may also be provided on the glasses 1400, and may be used to transmit external sounds (for example, a user's voice, ambient sound, etc.) to the microphones in the glasses 1400. The sound inlet holes 1413 may be provided at a position facilitating an acquisition of the user's voice on the glasses 1400, for example, a position near the user's mouth on the leg 1410 and/or 1420, a position near the user's mouth under the lens ring 1430, a position on the nose pad 1450, or any combination thereof. In some embodiments, shapes, sizes, and counts of the one or more hollow structures on the glasses 1400 may vary according to actual needs. For example, the shapes of the hollow structures may include, but not limited to, a square shape, a rectangle shape, a triangle shape, a polygon shape, a circle shape, an ellipse shape, an irregular shape, or the like.

In some embodiments, the glasses 1400 may be further provided with one or more button structures, which may be used to implement interact ions between the user and the glasses 1400. As shown in FIG. 14, the one or more button structures may include a power button 1421, a sound adjustment button 1422, a playback control button 1423, a bluetooth button 1424, or the like. The power button 1421 may include a power on button, a power off button, a power hibernation button, or the like, or any combination thereof. The sound adjustment button 1422 may include a sound increase button, a sound decrease button, or the like, or any combination thereof. The playback control button 1423 may include a playback button, a pause button, a resume playback button, a call playback button, a call drop button, a call hold button, or the like, or any combination thereof. The bluetooth button 1424 may include a bluetooth connection button, a bluetooth off button, a selection button, or the like, or any combination thereof. In some embodiments, the button structures may be provided on the glasses 1400. For example, the power button may be provided on the leg 1410, the leg 1420, or the lens ring 1430. In some embodiments, the one or more button structures may be provided in one or more control devices. The glasses 1400 may be connected to the one or more control devices via a wired or wireless connection. The control devices may transmit instructions input by the user to the glasses 1400, so as to control the operations of the one or more components in the glasses 1400.

In some embodiments, the glasses 1400 may also include one or more indicators to indicate information of one or more components in the glasses 1400. For example, the indicators may be used to indicate a power status, a bluetooth connection status, a playback status, or the like, or any combination thereof. In some embodiments, the indicators may indicate related information of the components via different indicating conditions (for example, different colors, different time, etc.). Merely by way of example, when a power indicator is red, it is indicated that the power source assembly may be in a state of low power. When the power indicator is green, indicating that the power source assembly may be a state of full power. As another example, a bluetooth indicator may flash intermittently, indicating that the bluetooth is connecting to another device. The bluetooth indicator may be blue, indicating that the bluetooth may be connected successfully.

In some embodiments, a sheath may be provided on the leg 1410 and/or the leg 1420. The sheath may be made of soft material with a certain elasticity, such as silicone, rubber, etc., so as to provide a better sense of touch for the user.

In some embodiments, the frame may be formed integrally, or assembled by plugging, inserting, or the like. In some embodiments, materials used to manufacture the frame may include but not limited to, steel, alloy, plastic, or other single or composite materials. The steel may include but not limited to, stainless steel, carbon steel, or the like. The alloy may include but is not limited to, aluminum alloy, chromium-molybdenum steel, rhenium alloy, magnesium alloy, titanium alloy, magnesium-lithium alloy, nickel alloy, or the like. The plastic may include but not limited to, acrylonitrile-butadiene-styrene copolymer (Acrylonitrile butadiene styrene, ABS), polystyrene (PS), high impact polystyrene (HIPS), polypropylene (PP), polyethylene terephthalate (PET), polyester (PES), polycarbonate (PC), polyamide (PA), polyvinyl chloride (PVC), polyethylene and blown nylon, or the like. The single or composite materials may include but not limited to, glass fiber, carbon fiber, boron fiber, graphite fiber, graphene fiber, silicon carbide fiber, aramid fiber and other reinforcing materials; or a composite of other organic and/or inorganic materials, such as glass fiber reinforced unsaturated polyester, various types of glass steel with epoxy resin or phenolic resin, etc.

The description of the glasses 1400 may be provided for illustration purposes and not intended to limit the scope of the present disclosure. For those skilled in the art, various changes and modifications may be made according to the description of the present disclosure. For example, the glasses 1400 may include one or more cameras to capture environmental information (for example, scenes in front of the user). As another example, the glasses 1400 may also include one or more projectors for projecting pictures (for example, pictures that users see through the glasses 1400) onto a display screen.

Figure 15:
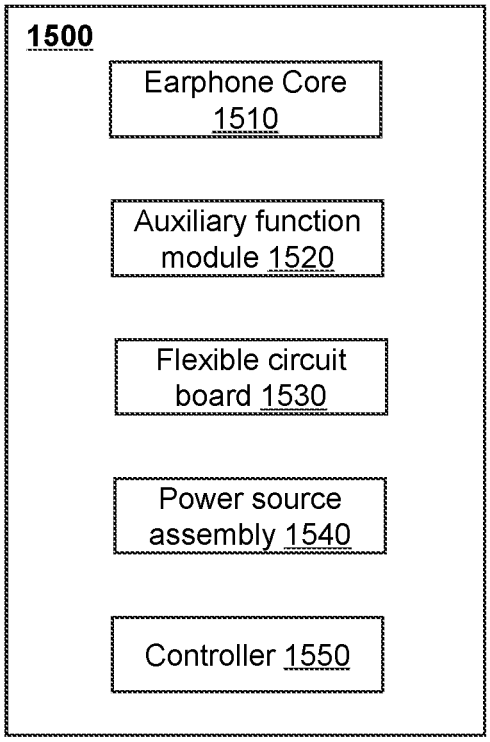
FIG. 15 is a schematic diagram illustrating exemplary components in an acoustic output apparatus according to some embodiments of the present disclosure.

FIG. 15 is a schematic diagram illustrating components in an acoustic output apparatus (e.g., the glasses 1400). As shown in FIG. 15, the acoustic output apparatus 200 may include one or more of an earphone core 1510, an auxiliary function module 1520, a flexible circuit board 1530, a power source assembly 1540, a controller 1550, or the like.

The earphone core 1510 may be configured to process signals containing audio information, and convert the signals into sound signals. The audio information may include video or audio files with a specific data format, or data or files that may be converted into sound in a specific manner. The signals containing the audio information may include electrical signals, optical signals, magnetic signals, mechanical signals or the like, or any combination thereof. The processing operation may include frequency division, filtering, denoising, amplification, smoothing, or the like, or any combination thereof. The conversion may involve a coexistence and interconversion of energy of different types. For example, the electrical signal may be converted into mechanical vibrations that generates sound through the earphone core 1510 directly. As another example, the audio information may be included in the optical signal, and a specific earphone core may implement a process of converting the optical signal into a vibration signal. Energy of other types that may coexist and interconvert to each other during the working process of the earphone core 1510 may include thermal energy, magnetic field energy, and so on.

In some embodiments, the earphone core 1510 may include one or more acoustic drivers. The acoustic driver(s) may be used to convert electrical signals into sound for playback.

The auxiliary function module 1520 may be configured to receive auxiliary signals and execute auxiliary functions. The auxiliary function module 1520 may include one or more microphones, key switches, bluetooth modules, sensors, or the like, or any combination thereof. The auxiliary signals may include status signals (for example, on, off, hibernation, connection, etc.) of the auxiliary function module 1520, signals generated through user operations (for example, input and output signals generated by the user through keys, voice input, etc.), signals in the environment (for example, audio signals in the environment), or the like, or any combination thereof. In some embodiments, the auxiliary function module 1520 may transmit the received auxiliary signals through the flexible circuit board 1530 to the other components in the acoustic output apparatus 1500 for processing.

A button module may be configured to control the acoustic output apparatus 1500, so as to implement the interaction between the user and the acoustic output apparatus 1500. The user may send a command to the acoustic output apparatus 1500 through the button module to control the operation of the acoustic output apparatus 1500. In some embodiments, the button module may include a power button, a playback control button, a sound adjustment button, a telephone control button, a recording button, a noise reduction button, a bluetooth button, a return button, or the like, or any combination thereof. The power button may be configured to control the status (on, off, hibernation, or the like) of the power source assembly module. The playback control button may be configured to control sound playback by the earphone core 1510, for example, playing information, pausing information, continuing to play information, playing a previous item, playing a next item, mode selection (e.g. a sport mode, a working mode, an entertainment mode, a stereo mode, a folk mode, a rock mode, a bass mode, etc.), playing environment selection (e.g., indoor, outdoor, etc.), or the like, or any combination thereof. The sound adjustment button may be configured to control a sound amplitude of the earphone core 1510, for example, increasing the sound, decreasing the sound, or the like. The telephone control button may be configured to control telephone answering, rejection, hanging up, dialing back, holding, and/or recording incoming calls. The record button may be configured to record and store the audio information. The noise reduction button may be configured to select a degree of noise reduction. For example, the user may select a level or degree of noise reduction manually, or the acoustic output apparatus 1500 may select a level or degree of noise reduction automatically according to a playback mode selected by the user or detected ambient sound. The bluetooth button may be configured to turn on bluetooth, turn off bluetooth, match bluetooth, connect bluetooth, or the like, or any combination thereof. The return button may be configured to return to a previous menu, interface, or the like.

A sensor may be configured to detect information related to the acoustic output apparatus 1500 and/or status information of a user of the acoustic output apparatus 1500. For example, the sensor may be configured to detect the user's fingerprint, and transmit the detected fingerprint to the controller 1550. The controller 1550 may match the received fingerprint with a fingerprint pre-stored in the acoustic output apparatus 1500. If the matching is successful, the controller 1550 may generate an instruction that may be transmitted to each component to initiate the sound output apparatus 1500. As another example, the sensor may be configured to detect the position of the acoustic output apparatus 1500. When the sensor detects that the acoustic output apparatus 1500 is detached from a user's face, the sensor may transmit the detected information to the controller 1550, and the controller 1550 may generate an instruction to pause or stop the playback of the acoustic output apparatus 1500. In some embodiments, exemplary sensors may include a ranging sensor (e.g., an infrared ranging sensor, a laser ranging sensor, etc.), a speed sensor, a gyroscope, an accelerometer, a positioning sensor, a displacement sensor, a pressure sensor, a gas sensor, a light sensor, a temperature sensor, a humidity sensor, a fingerprint sensor, an image sensor, an iris sensor, an image sensor (e.g., a vidicon, a camera, etc.), or the like, or any combination thereof.

The flexible circuit board 1530 may be configured to connect different components in the acoustic output apparatus 1500. The flexible circuit board 1530 may be a flexible printed circuit (FPC). In some embodiments, the flexible circuit board 1530 may include one or more bonding pads and/or one or more flexible wires. The one or more bonding pads may be configured to connect the one or more components of the acoustic output apparatus 1500 or other bonding pads. One or more leads may be configured to connect the components of the acoustic output apparatus 1500 with one bonding pad, two or more bonding pads, or the like. In some embodiments, the flexible circuit board 1530 may include one or more flexible circuit boards. Merely by ways of example, the flexible circuit board 1530 may include a first flexible circuit board and a second flexible circuit board. The first flexible circuit board may be configured to connect two or more of the microphone, the earphone core 1510, and the controller 1550. The second flexible circuit board may be configured to connect two or more of the power source assembly 1540, the earphone core 1510, the controller 1550, or the like. In some embodiments, the flexible circuit board 1530 may be an integral structure including one or more regions. For example, the flexible circuit board 1530 may include a first region and a second region. The first region may be provided with flexible leads for connecting the bonding pads on the flexible circuit board 1530 and other components on the acoustic output apparatus 1500. The second region may be configured to set one or more bonding pads. In some embodiments, the power source assembly 1540 and/or the auxiliary function module 1520 may be connected to the flexible circuit board 1530 (for example, the bonding pads) through the flexible leads of the flexible circuit board 1530.

The power source assembly 1540 may be configured to provide electrical power to the components of the acoustic output apparatus 1500. In some embodiments, the power source assembly 1540 may include a flexible circuit board, a battery, etc. The flexible circuit board may be configured to connect the battery and other components of the acoustic output apparatus 1500 (for example, the earphone core 1510), and provide power for operations of the other components. In some embodiments, the power source assembly 1540 may also transmit its state information to the controller 1550 and receive instructions from the controller 1550 to perform corresponding operations. The state information of the power source assembly 1540 may include an on/off state, state of charge, time for use, a charging time, or the like, or any combination thereof. In some embodiments, the power source assembly may include a body region and a sealing region. The thickness of the body region may be greater than the thickness of the sealing region. A side surface of the sealing region and a side surface of the body region may have a shape of a stair.

According to information of the one or more components of the acoustic output apparatus 1500, the controller 1550 may generate an instruction to control the power source assembly 1540. For example, the controller 1550 may generate control instructions to control the power source assembly 1540 to provide power to the earphone core 1510 for generating sound. As another example, when the acoustic output apparatus 1500 does not receive input information within a certain time, the controller 1550 may generate a control instruction to control the power source assembly 1540 to enter a hibernation state. In some embodiments, the power source assembly 1540 may include a storage battery, a dry battery, a lithium battery, a Daniel battery, a fuel battery, or any combination thereof.

Merely by way of example, the controller 1550 may receive a sound signal from the user, for example, "play a song", from the auxiliary function module 1520. By processing the sound signal, the controller 1550 may generate control instructions related to the sound signal. For example, the control instructions may control the earphone core 1510 to obtain information of songs from the storage module (or other devices). Then an electric signal for controlling the vibration of the earphone core 1510 may be generated according to the information.

In some embodiments, the controller 1550 may include one or more electronic frequency division modules. The electronic frequency division modules may divide a frequency of a source signal. The source signal may come from one or more sound source apparatus (for example, a memory storing audio data) integrated in the acoustic output apparatus. The source signal may also be an audio signal (for example, an audio signal received from the auxiliary function module 1520) received by the acoustic output apparatus 1500 in a wired or wireless manner. In some embodiments, the electronic frequency division modules may decompose an input source signal into two or more frequency-divided signals containing different frequencies. For example, the electronic frequency division module may decompose the source signal into a first frequency-divided signal with high-frequency sound and a second frequency-divided signal with low-frequency sound. Signals processed by the electronic frequency division modules may be transmitted to the acoustic driver in the earphone core 1510 in a wired or wireless manner.

In some embodiments, the controller 1550 may include a central processing unit (CPU), an application-specific integrated circuit (ASIC), an application-specific instruction-set processor (ASIP), a graphics processing unit (GPU), a physical processing unit (PPU), a digital signal processor (DSP), a field-programmable gate array (FPGA), a programmable logic device (PLD), a controller, a microcontroller unit, a reduced instruction set computer (RISC), a microprocessor, or the like, or any combination thereof.

In some embodiments, one or more of the earphone core 1510, the auxiliary function module 1520, the flexible circuit board 1530, the power source assembly 1530, and the controller 1550 may be provided in the frame of the glasses 1400. Specifically, one or more of the electronic components may be provided in the hollow structure of the leg 1410 and/or the leg 1420. The connection and/or communication between the electronic components provided in the leg 1410 and/or the leg 1420 may be wired or wireless. The wired connection may include metal cables, fiber optical cables, hybrid cables, or the like, or any combination thereof. The wireless connection may include a local area network (LAN), a wide area network (WAN), a bluetooth, a ZigBee, a near field communication (NFC), or the like, or any combination thereof.

The description of the acoustic output apparatus 1500 may be for illustration purposes, and not intended to limit the scope of the present disclosure. For those skilled in the art, various changes and modifications may be made according to the description of the present disclosure. For example, the components and/or functions of the acoustic output apparatus 1500 may be changed or modified according to a specific implementation. For example, the acoustic output apparatus 1500 may include a storage component for storing signals containing audio information. As another example, the acoustic output apparatus 1500 may include one or more processors, which may execute one or more sound signal processing algorithms for processing sound signals. These changes and modifications may remain within the scope of the present disclosure.

Figure 16:
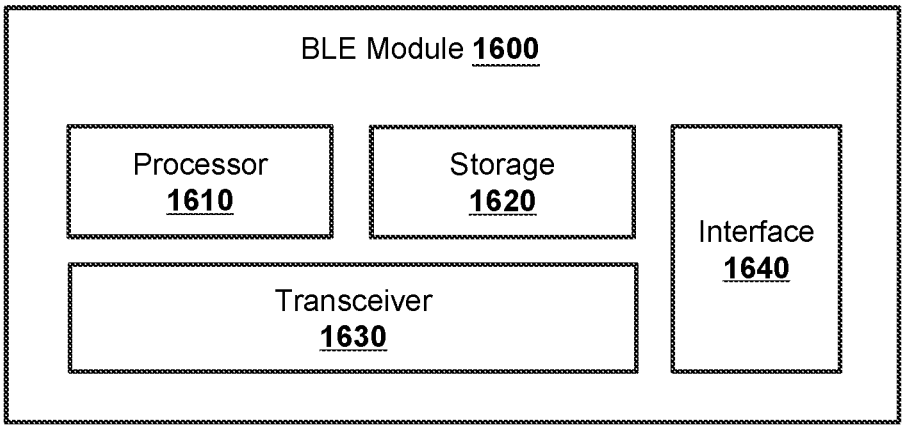
FIG. 16 is a schematic diagram illustrating a bluetooth low energy (BLE) module according to some embodiments of the present disclosure.

FIG. 16 is a schematic diagram illustrating a bluetooth low energy (BLE) module according to some embodiments of the present disclosure. In some embodiments, the acoustic output apparatus (e.g., the glasses 1400) may further include a BLE module 1600. For example, the bluetooth modules used in the glasses 100 may be implemented by the BLE module. The BLE module 1600 may include a processor 1610, a storage 1620, a transceiver 1630, and an interface 1640.

The BLE module 1600 may facilitate communications between components of the acoustic output apparatus (e.g., one or more sensors such as a locating sensor, an orientation sensor, an inertial sensor, etc.) or the acoustic output apparatus and an external device (e.g., a terminal device of a user, a cloud data center, a peripheral device of the acoustic output apparatus, etc.) using BLE technology. The locating sensor may determine a geographic location of the acoustic output apparatus, for example, based on one or more location-based detection systems such as a global positioning system (GPS), a Wi-Fi location system, an infra-red (IR) location system, a bluetooth beacon system, etc. The orientation sensor may track an orientation of the user and/or the acoustic output apparatus. The orientation sensor may include a head-tracking device and/or a torso-tracking device for detecting a direction in which the user is facing, as well as the movement of the user and/or the acoustic output apparatus. The inertial sensor may sense gestures of the user or a body part (e.g., head, torso, limbs) of the user. The inertial sensor may include an accelerometer, a gyroscope, a magnetometer, or the like, or any combination thereof. BLE is a wireless communication technology published by the Bluetooth Special Interest Group (BT-SIG) standard as a component of Bluetooth Core Specification Version 4.0. BLE is a lower power, lower complexity, and lower cost wireless communication protocol, designed for applications requiring lower data rates and shorter duty cycles. Inheriting the protocol stack and star topology of classical Bluetooth, BLE redefines the physical layer specification, and involves new features such as a very-low power idle mode, a simple device discovery, and short data packets, etc.

The transceiver 1630 may receive data (e.g., an audio message) to be played by the acoustic output apparatus. The transceiver 1630 may include any suitable logic and/or circuitry to facilitate receiving signals from and/or transmitting signals to other components of the acoustic output apparatus or an external device wirelessly. In some embodiments, the transceiver 1630 may transmit the received data to the processor 1610 for processing. For example, the processor 1610 may perform a noise reduction on the received data. As another example, the processor 1610 may serve as an equalizer, which adjusts the volume, the tone, etc. of an audio message adaptively according to actual needs. In some embodiments, the processor 1610 may execute instructions embodied in software (including firmware) associated with the operations of BLE module 1600 for managing the operations of transceiver 1630. In some embodiments, the processor 1610 may facilitate processing and forwarding of received data from the transceiver 1630 and/or processing and forwarding of data to be transmitted by the transceiver 1630. The storage 1620 may store one or more instructions executed by the processor 1610, dated received from the transceiver 1630 and/or data to be transmitted by the transceiver 1630, or the like. The storage 1620 may include but is not limited to, RAM, ROM, flash memory, a hard drive, a solid state drive, or other volatile and/or non-volatile storage devices. The BLE module 1600 may interact with one or more modules or components of the acoustic output apparatus via the interface 1640.

It will be appreciated that, in some embodiments, the functionality of one or more of the processor 1610, the storage 1620, the transceiver 1630, and/or the interface 1640 may be integrated with one or more modules of the acoustic output apparatus on a same circuit board, such as a system on a chip (SOC), an application specific integrated circuit (ASIC), etc. In some embodiments, the BLE module 1600 or one or more components thereof may be integrated on a same circuit board with the earphone core 1510 and/or the controller 1550. The circuit board may connect to the power source assembly through the flexible circuit board 1530.

Figure 17:
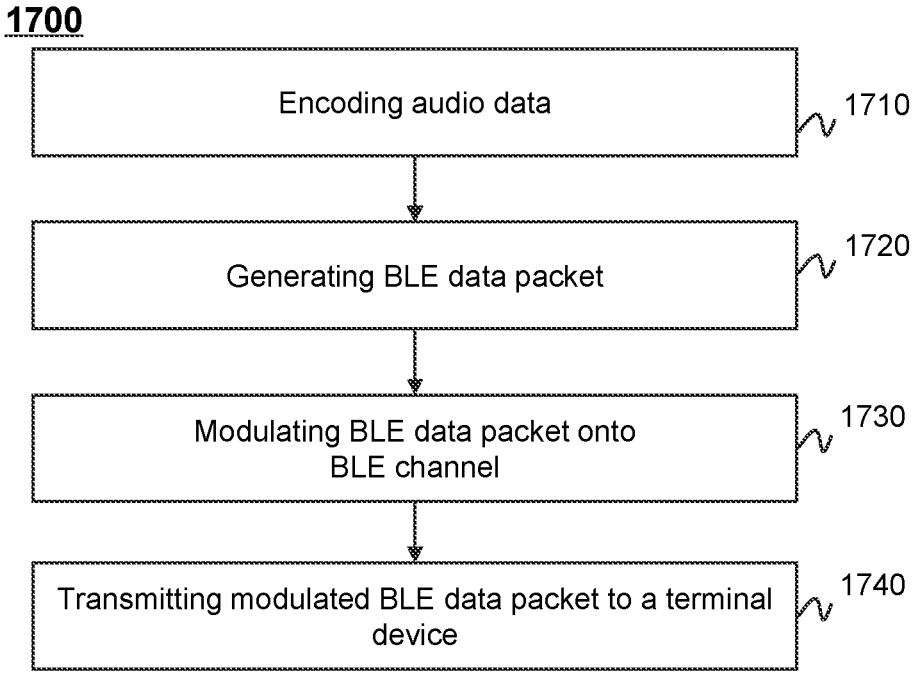
FIG. 17 is a flow chart illustrating an exemplary process for transmitting audio data to a terminal device through the BLE module according to some embodiments of the present disclosure.

FIG. 17 is a flow chart illustrating an exemplary process for transmitting audio data to a terminal device through the BLE module according to some embodiments of the present disclosure.

In 1710, audio data may be encoded. In some embodiments, the acoustic output apparatus may transmit audio data to a terminal device (e.g., a loudspeaker, a mobile phone, etc.) through the BLE module 1600. The BLE module 1600 may encode the audio data to be transmitted. In some embodiments, the BLE module 1600 may encode the audio data using a Low Complexity Communications Codec (LC3).

In 1720, a BLE data packet may be generated. A BLE data packet may be generated based on encoded audio data. In some embodiments, the BLE module 1600 may obtain parameters or attributes associated with the audio data before the BLE data packets are generated. The parameters or attributes associated with the audio data may include parameters for decoding the audio data (e.g., the codec of the audio data), parameters for demodulating the audio data, the volume of the audio data, the tone of the audio data, the content of the audio data, or the like, or any combination thereof. In some embodiments, the BLE data packets may also include the parameters or attributes associated with the audio data. In some embodiments, the audio data may be divided into multiple data segments of particular sizes if the audio data is oversized. A BLE data packet may be generated based on each data segment such that the transmission speed of the audio data may be improved.

In 1730, the BLE data packet may be modulated onto a BLE channel. In some embodiments, if the audio data is divided into multiple data segments, multiple BLE channels may be established, and each of the multiple data segments may be modulated onto a BLE channel.

In 1740, the modulated BLE data packet may be transmitted to a terminal device through the BLE channel. In some embodiments, data transmission between the BLE module 1600 and the terminal device may be implemented according to a protocol suitable for BLE (e.g., LE audio). After the terminal device receives the audio data, the playback of the audio data on the terminal device may be realized according to the parameters or attributes associated with the audio data.

Figure 18:
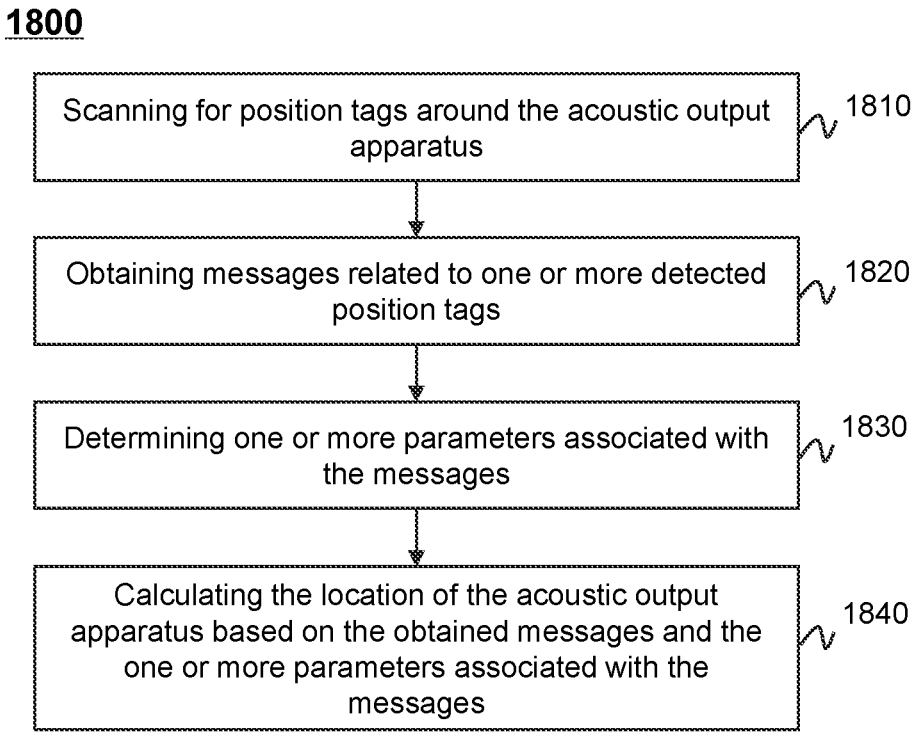
FIG. 18 is a flow chart illustrating an exemplary process for determining a location of the acoustic output apparatus using the BLE module according to some embodiments of the present disclosure.

FIG. 18 is a flow chart illustrating an exemplary process for determining a location of the acoustic output apparatus using the BLE module according to some embodiments of the present disclosure.

In some embodiments, the BLE module may determine a location of the acoustic output apparatus. The BLE module may function as the locating sensor. In some embodiments, the locating sensor may be omitted in the acoustic output apparatus, thus reducing the size, the weight, and the power consumption of the acoustic output apparatus. In some embodiments, the BLE module may determine the location of the acoustic output apparatus by performing the operations 1810 through 1840 in the process 1800.

In 1810, position tags around the acoustic output apparatus may be scanned. In some embodiments, a position tag refers to an identifier indicating a position of a BLE device. In some embodiments, the identifier may include a character string representing the position of the BLE device. In some embodiments, the identifier may further include character strings representing a name, a service, a device ID, etc., of the BLE device. In some embodiment, the BLE device may be a BLE transceiver set at a virtual or physical location. In some embodiments, the BLE device may be another BLE module implemented in a terminal device (e.g., a mobile phone, a smart wearable device, etc.) of a user. In some embodiments, the BLE module 1600 may scan for position tags in a certain range (for example, in a circular range centered by the acoustic output apparatus with a radius of 100 meters). In some embodiments, the manner in which the scanning operation is performed, a frequency of scanning operation, and a width of a scanning window (e.g., the certain range) of the scanning operation may be set by a user (e.g., a wearer of the acoustic output apparatus), according to default settings of the acoustic output apparatus, etc. Within the scanning window, the BLE module 1600 may detect position tags of multiple BLE devices sensed by the transceiver 1630.

In 1820, messages related to one or more detected position tags may be obtained within the scanning window. In some embodiments, the BLE module 1600 may detect multiple position tags, and obtain messages including identifiers from BLE devices corresponding to the multiple position tags. In some embodiments, the processor 1610 of the BLE module 1600 may determine if the messages are obtained from "allowed" BLE devices (e.g., qualified BLE transceivers). The BLE module 1600 may determine a value of an identifier contained in each message. In some embodiments, a value of an identifier contained in a message may be determined based on at least one of character strings of the position, the name, the service, the device ID, etc. of the identifier. The processor 1610 of the BLE module 1600 may compare the value with one or more preset values. In some embodiments, the BLE module 1600 may identify the one or more position tags and corresponding "allowed" BLE devices according to the comparison. In some embodiments, in order to provide a relatively precise position of the acoustic output apparatus, at least three position tags may be obtained within the scanning window.

In 1830, one or more parameters associated with the messages may be determined. When the BLE module 1600 confirms that the messages are obtained from the "allowed" BLE devices, the processor 1610 may instruct the BLE module 1600 to record a radio parameter associated with each message. In some embodiments, the radio parameter may include a received signal strength indicator (RSSI) value, a bit error rate (BER), etc. In some embodiments, the message, the radio parameter regarding the message, and the identifier obtained from the message may be stored in the storage 1620.

In 1840, the location of the acoustic output apparatus may be calculated based on the obtained messages and the one or more parameters associated with the messages. In some embodiments, the processor 1610 may calculate a relative location of the acoustic output apparatus relative to the "allowed" BLE devices from which the one or more position tags are obtained based on the messages and the one or more parameters associated with the messages. Since locations of the "allowed" BLE devices are known, the location of the acoustic output apparatus (e.g., in forms of coordinates of latitude and longitude) may be determined based on the relative location of the acoustic output apparatus relative to the "allowed" BLE devices. The determination of the location of the acoustic output apparatus may be performed using any suitable methods. In this way, the calculation of the location of the acoustic output apparatus may use less battery power. In some embodiments, if there are more than three position tags are detected, and messages related to the position tags are obtained, the processor 1610 may rank the messages according to the RSSI values associated with the messages. Messages corresponding to three highest RSSI values may be identified from the more than three messages, and the identified messages and the one or more parameters associated with the messages may be used to determine the location of the acoustic output apparatus.

In some embodiments, the location of the acoustic output apparatus may be determined at any suitable frequency. Determined locations of the acoustic output apparatus may be filtered in any suitable manner so as to minimize errors due to external factors, such as a person standing between the acoustic output apparatus and the "allowed" BLE devices.

The embodiments described above are merely implements of the present disclosure, and the descriptions may be specific and detailed, but these descriptions may not limit the present disclosure. It should be noted that those skilled in the art, without deviating from concepts of the bone conduction speaker, may make various modifications and changes to, for example, the sound transfer approaches described in the specification, but these combinations and modifications are still within the scope of the present disclosure.

What is claimed is:

1. An acoustic output apparatus, comprising:

a vibration device having a vibration conductive plate and a vibration board, wherein the vibration conductive plate is physically connected with the vibration board, vibrations generated by the vibration conductive plate and the vibration board have at least two resonance peaks, frequencies of the at least two resonance peaks being catchable with human ears, and sounds are generated by the vibrations transferred through a human bone; and a Bluetooth low energy (BLE) module configured to establish communication between the acoustic output apparatus and a terminal device of a user.

2. The acoustic output apparatus of claim 1, wherein the BLE module is configured to transmit audio data between the acoustic output apparatus and the terminal device.

3. The acoustic output apparatus of claim 2, wherein to transmit the audio data between the acoustic output apparatus and the terminal device, the BLE module is configured to:

encode the audio data;

generate a BLE data packet based on the encoded audio data and attributes of the audio data;

modulate the BLE data packet onto a BLE channel; and transmit the modulated BLE data packet to the terminal device through the BLE channel.

4. The acoustic output apparatus of claim 3, wherein the BLE data packet includes one or more parameters or the attributes of the audio data, and the one or more parameters or the attributes of the audio data includes at least one of parameters for decoding the audio data, parameters for demodulating the audio data, a volume of the audio data, a tone of the audio data, or a content of the audio data.

5. The acoustic output apparatus of claim 1, wherein the BLE module is further configured to determine a location of the user.

6. The acoustic output apparatus of claim 5, wherein to determine the location of the user, the BLE module is configured to:

scan position tags around the acoustic output apparatus;

obtain messages related to one or more detected position tags within a scanning window;

determine one or more parameters associated with the messages; and calculate the location of the acoustic output apparatus based on the messages and the one or more parameters associated with the messages.

7. The acoustic output apparatus of claim 6, wherein a position tag of the position tags represents an identifier indicating a position of a BLE device.

8. The acoustic output apparatus of claim 6, wherein to obtain messages related to one or more detected position tags within a scanning window, the BLE module is further configured to:

determine a value of the identifier contained in the message;

obtain a comparison result by comparing the value of the identifier with one or more preset values; and identify, based on the comparison result, the position tags.

9. The acoustic output apparatus of claim 1, wherein the acoustic output apparatus further includes:

one or more sensors configured to detect status information of the user of the acoustic output apparatus;

a controller configured to cause the vibration device to output sound based on the detected status information of the user;

a power source assembly configured to provide electrical power to the vibration device, the one or more sensors, and the controller; and a flexible circuit board configured to connect at least the vibration device and the power source assembly, the BLE module being integrated on a same circuit board with the controller and the vibration device, the circuit board being connected to the power source assembly through the flexible circuit board.

10. The acoustic output apparatus of claim 9, wherein the one or more sensors include at least one of a locating sensor, an orientation sensor, an inertial sensor, an audio sensor, or a wireless transceiver.

11. The acoustic output apparatus e according to claim 1, wherein the vibration conductive plate includes a first torus and at least two first rods, the at least two first rods converging to a center of the first torus.

12. The acoustic output apparatus according to claim 11, wherein the vibration board includes a second torus and at least two second rods, the at least two second rods converging to a center of the second torus.

13. The acoustic output apparatus according to claim 12, wherein the first torus is fixed on a magnetic component.

14. The acoustic output apparatus according to claim 13, further comprising a voice coil, wherein the voice coil is driven by the magnetic component and fixed on the second torus.

15. The acoustic output apparatus according to claim 14, wherein the at least two first rods are staggered with the at least two second rods.

16. The acoustic output apparatus according to claim 15, wherein a staggered angle between one of the at least two first rods and one of the at least two second rods is a predetermined angle.

17. The acoustic output apparatus according to claim 14, wherein the magnetic component comprises:

a bottom plate;

an annular magnet attaching to the bottom plate;

an inner magnet concentrically disposed inside the annular magnet;

an inner magnetic conductive plate attaching to the inner magnet;

an annular magnetic conductive plate attaching to the annular magnet; and a grommet attaching to the annular magnetic conductive plate.

18. The acoustic output apparatus according to claim 1, wherein the vibration conductive plate is made of stainless steels and has a thickness in a range of 0.1 to 0.2 mm.

19. The acoustic output apparatus according to claim 1, wherein a lower resonance peak of the at least two resonance peaks is equal to or lower than 900 Hz.

20. The acoustic output apparatus according to claim 19, wherein a higher resonance peak of the at least two resonance peaks is equal to or lower than 9500 Hz.

* * * * *